US010025252B2

(12) United States Patent
Matsuda et al.

(10) Patent No.: US 10,025,252 B2
(45) Date of Patent: Jul. 17, 2018

(54) IMAGE FORMING APPARATUS

(71) Applicants: Naoki Matsuda, Kanagawa (JP); Masahiro Ishida, Kanagawa (JP); Yoshihide Ohta, Kanagawa (JP)

(72) Inventors: Naoki Matsuda, Kanagawa (JP); Masahiro Ishida, Kanagawa (JP); Yoshihide Ohta, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/879,584

(22) Filed: Jan. 25, 2018

(65) Prior Publication Data

US 2018/0150017 A1 May 31, 2018

Related U.S. Application Data

(63) Continuation of application No. 14/962,113, filed on Dec. 8, 2015, now Pat. No. 9,904,229.

(30) Foreign Application Priority Data

Dec. 9, 2014 (JP) ..... 2014-249189
Mar. 16, 2015 (JP) ..... 2015-052156
(Continued)

(51) Int. Cl.
*G03G 15/00* (2006.01)
*G10K 11/172* (2006.01)

(52) U.S. Cl.
CPC ..... *G03G 15/6552* (2013.01); *G10K 11/172* (2013.01)

(58) Field of Classification Search
None
See application file for complete search history.

(56) References Cited

U.S. PATENT DOCUMENTS 3,451,503 A 6/1969 Twomey
5,121,811 A 6/1992 Shima et al.
(Continued)

FOREIGN PATENT DOCUMENTS

JP S63-239076 A 10/1988
JP H06-8579 A 1/1994
(Continued)

OTHER PUBLICATIONS

Office Action for Corresponding Japanese Patent Application No. 2015-131357 dated Nov. 25, 2016.
(Continued)

*Primary Examiner* — Sevan A Aydin
(74) *Attorney, Agent, or Firm* — Harness, Dickey & Pierce, P.L.C.

(57) ABSTRACT

An image forming apparatus includes an apparatus body, an image forming section, an ejected recording medium container, and a sound absorber. The image forming section forms an image on a recording medium and ejects the recording medium from an ejection port. The ejected recording medium container includes an opening at at least one side of the apparatus body and a space facing the ejection port to contain the recording medium ejected from the ejection port. The sound absorber is disposed on the ejected recording medium container.

8 Claims, 15 Drawing Sheets

(30) Foreign Application Priority Data

Jun. 30, 2015 (JP) ..... 2015-131357
Nov. 17, 2015 (JP) ..... 2015-224442

(56) References Cited

U.S. PATENT DOCUMENTS

2006/0050346 A1 3/2006 Kim
2009/0272601 A1 11/2009 Hagiwara
2009/0285432 A1 11/2009 Schnitta et al.
2011/0187769 A1* 8/2011 Hiraide ..... B41J 29/38 347/5
2013/0175114 A1 7/2013 Heo et al.
2015/0241838 A1 8/2015 Ishida et al.
2015/0267404 A1 9/2015 Yau et al.

FOREIGN PATENT DOCUMENTS

JP H07140744 A 6/1995
JP H09-230658 A 9/1997
JP 2000-077858 A 3/2000
JP 2000-112306 A 4/2000
JP 2000-235396 A 8/2000
JP 2002-057475 A 2/2002
JP 2003-069765 A 3/2003
JP 2003-307890 A 10/2003
JP 2005-304162 A 10/2005
JP 2006-177683 A 7/2006
JP 2006-349849 A 12/2006
JP 2008049587 A 3/2008

OTHER PUBLICATIONS

Office Action for Corresponding Japanese Patent Application No. 2015-224442 dated Feb. 3, 2017.
Machine translation of Yamamoto et al., JP 2006-349849.

* cited by examiner

IMAGE FORMING APPARATUS

CROSS-REFERENCE TO RELATED APPLICATIONS

This patent application is a continuation of and claims priority under 35 U.S.C. §§ 120/121 to U.S. patent application Ser. No. 14/962,113, filed on Dec. 8, 2015, which is based on and claims priority pursuant to 35 U.S.C. § 119(a) to Japanese Patent Application Nos. 2014-249189, filed on Dec. 9, 2014, 2015-052156, filed on Mar. 16, 2015, 2015-131357, filed on Jun. 30, 2015, and 2015-224442, filed on Nov. 17, 2015, in the Japan Patent Office, the entire disclosures of each of which are incorporated by reference herein.

BACKGROUND

Technical Field

Aspects of this disclosure relate to an image forming apparatus.

Description of the Related Art

An image forming apparatus is known that includes a sound absorbing device using a Helmholtz resonator to suppress leakage of driving sound from the apparatus body.

For example, in an image forming apparatus, a sound absorber using a Helmholtz resonator is disposed in a member forming a recording medium conveyance path in the vicinity of an ejection port from which a recording medium, such as a transfer sheet, having an image formed thereon in an image forming section is ejected. Such a configuration reduces sound leaking out of the ejection port to the outside of the image forming apparatus.

However, in such an image forming apparatus, it is necessary to secure a space for disposing a resonance box of the Helmholtz resonator in the vicinity of the recording medium conveyance path in the vicinity of the ejection port. By providing the Helmholtz resonator, the size of the apparatus increases. This problem is not limited to image forming apparatuses using the Helmholtz resonator as the sound absorber, but is common to image forming apparatuses requiring a certain volume for disposing a sound absorber.

SUMMARY

In an aspect of this disclosure, there is provided an image forming apparatus that includes an apparatus body, an image forming section, an ejected recording medium container, and a sound absorber. The image forming section forms an image on a recording medium and ejects the recording medium from an ejection port. The ejected recording medium container includes an opening at at least one side of the apparatus body and a space facing the ejection port to contain the recording medium ejected from the ejection port. The sound absorber is disposed on the ejected recording medium container.

In another aspect of this disclosure, there is provided an image forming apparatus that includes an apparatus body, an image forming section, an ejected recording medium container, a sound absorber, and an electric board containing box. The image forming section forms an image on a recording medium and eject the recording medium from an ejection port. The ejected recording medium container has an opening at at least one side of the apparatus body and includes wall faces and a space surrounded with the wall faces. One of the wall faces includes the ejection port. The electric board containing box contains an electric board mounting a circuit with an electric component. The sound absorber and the electric board containing box are disposed on a wall face of the wall faces of the ejected recording medium container such that at least a part of the sound absorber is included in the electric board containing box.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 4A is a perspective view of the vicinity of the in-body sheet ejection part and FIG. 4B is a perspective view of a sound absorbing device when an electric unit bottom face is viewed from the downside;

FIG. 9A is a left side view of the image forming apparatus according to the comparative example and FIG. 9B is a view of a virtual apparatus in which an electric unit according to an embodiment of the present disclosure is added to the image forming apparatus according to the comparative example;

FIG. 12A is a cross-sectional top view and FIG. 12B is a side view;

Figure 1:
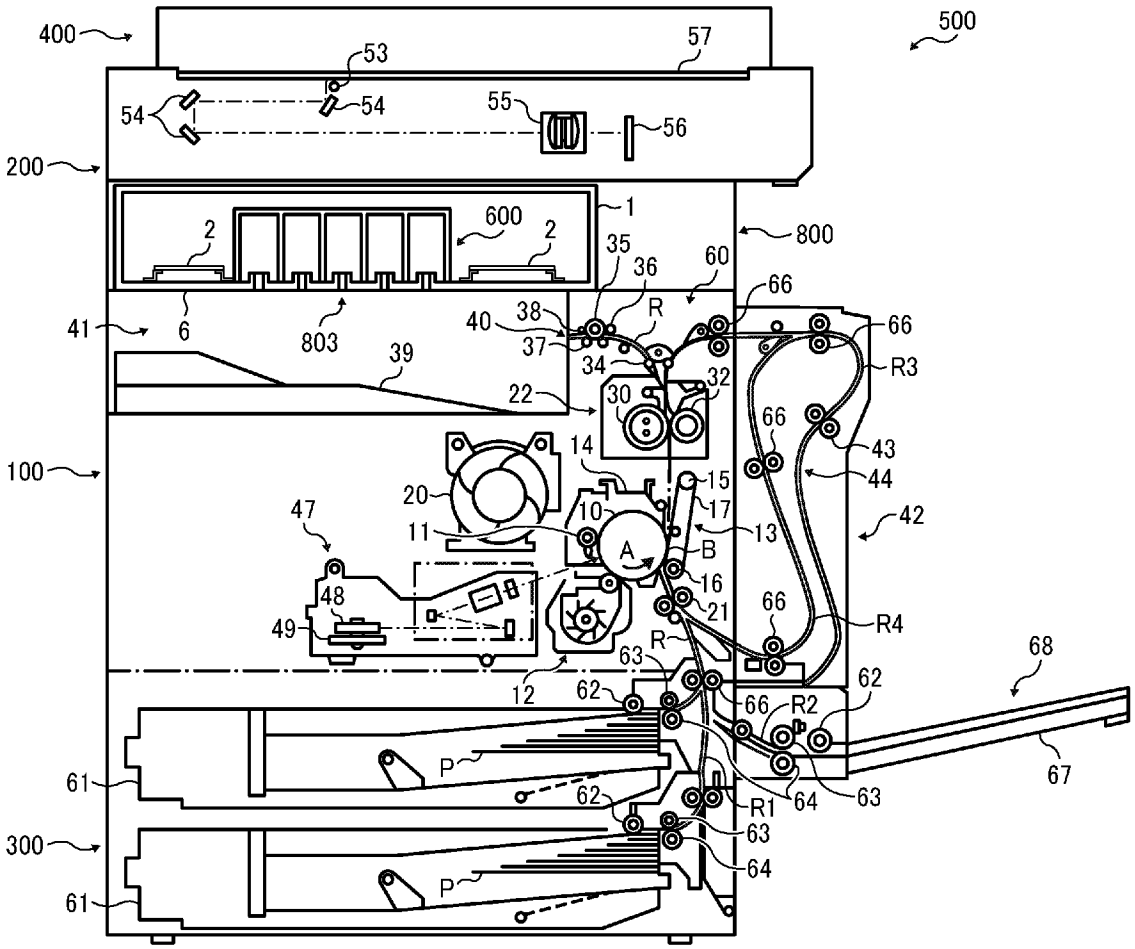
FIG. 1 is a schematic view of an entire configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an image forming apparatus 500 according to an embodiment of the present disclosure is illustrated as an electrophotographic copier. In this embodiment, a monochromatic copier is exemplified as the image forming apparatus 500. However, embodiments of the present invention are not limited to such a monochromatic copier and may be a color copier or other types of monochromatic or color image forming apparatuses, such as printers, facsimile machines, plotters, or multi-functional peripherals having at least one of the foregoing capabilities.

First, the configuration of the image forming apparatus 500 will be described. FIG. 1 is a schematic diagram of an entire configuration of the image forming apparatus 500 according to this embodiment. In FIG. 1, an image forming section 100 of the image forming apparatus 500 is placed on a recording sheet bank 300. An electric unit 800 is mounted on the image forming section 100 and a scanner 200 as an image reader is mounted thereon. An automatic document feeder 400 that is rotatable about a rear side (a depth side of a sheet face in FIG. 1) is mounted on the scanner 200. A drum-shaped photoconductor 10 is disposed as a latent image bearer in the image forming section 100.

Figure 2:
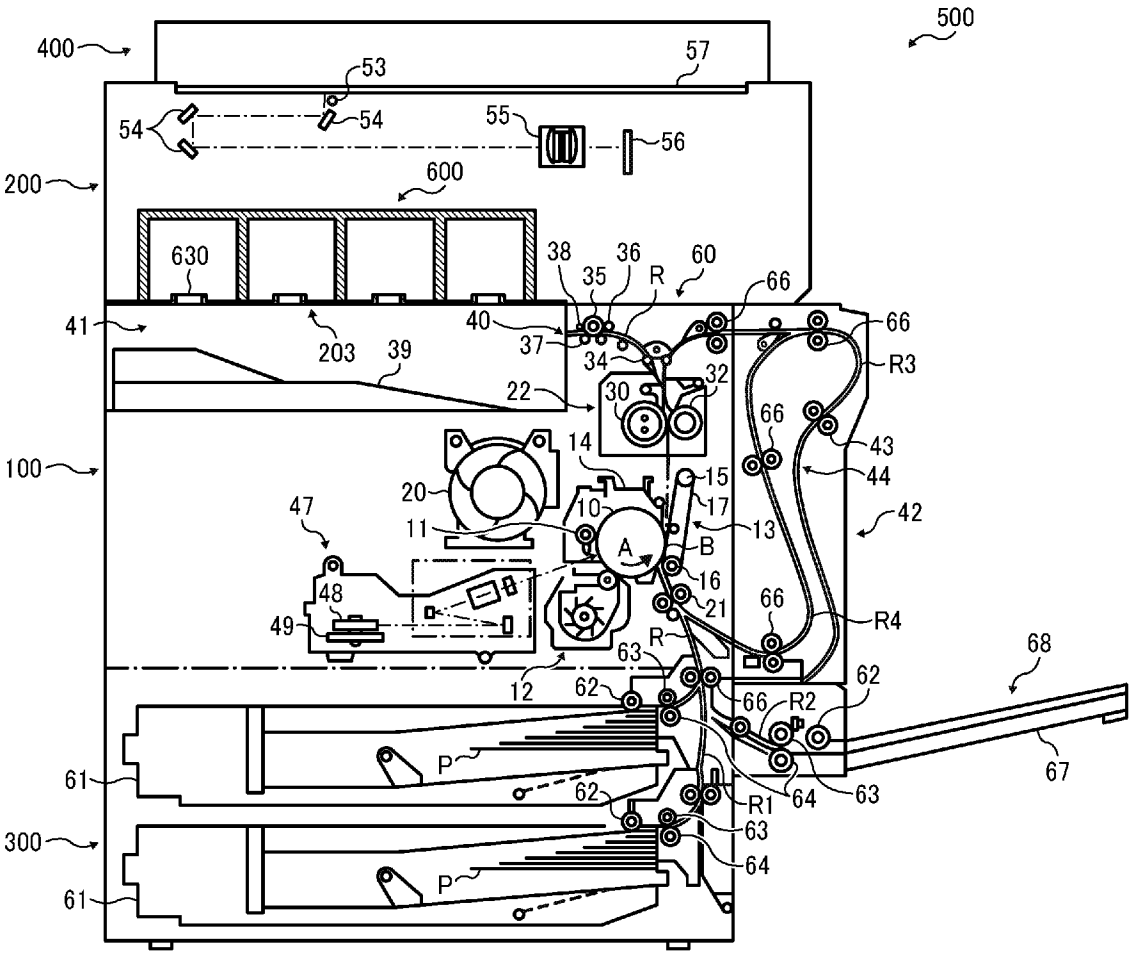
FIG. 2 is a schematic view of an entire configuration of a variation of the image forming apparatus of FIG. 1.

In this embodiment, as described below, the sound absorbing device 600 is mounted in the electric unit 800 between the image forming section 100 and the scanner 200. However, the arrangement of the sound absorbing device 600 is not limited to the arrangement illustrated in FIG. 1. For example, in an image forming apparatus 500 according to a variation of this embodiment, as illustrated in FIG. 2, a sound absorbing device 600 is disposed on a scanner bottom face 203 in a scanner 200. Unlike the sound absorbing device 600 of FIG. 1, the sound absorbing device 600 of FIG. 2 is not enclosed in an electronic box 1 of the electric unit 800 as illustrated in FIG. 1. For the image forming apparatus 500 of FIG. 2, a metal sheet forming part of the scanner 200 is processed by burring to form necks of a Helmholtz resonator. The necks form holes 630 of the Helmholtz resonator.

Figure 3:
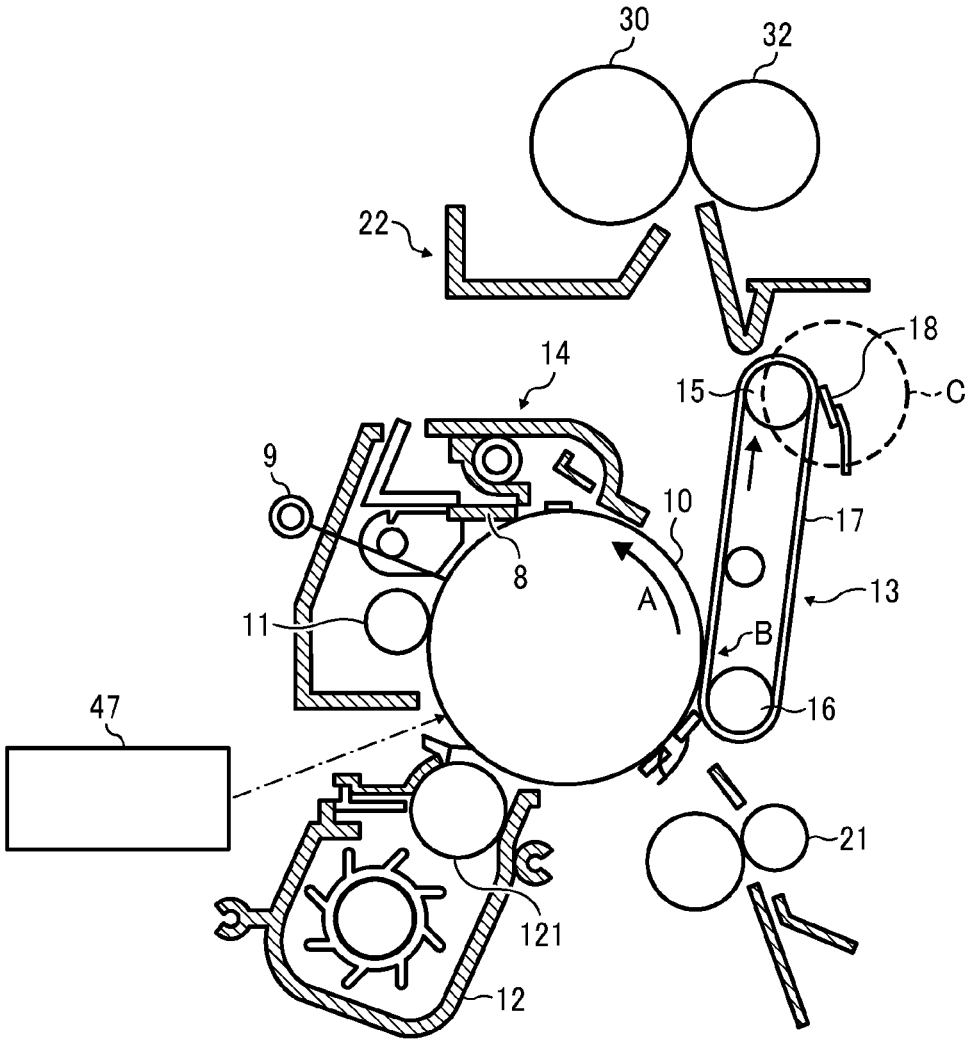
FIG. 3 is a schematic enlarged view of a configuration of the vicinity of a photoconductor according to an embodiment of the present disclosure.

FIG. 3 is a schematic enlarged view of a configuration of the vicinity of the photoconductor 10 in the image forming section 100. As illustrated in FIG. 3, an electric neutralization lamp 9, a charging device 11 using a charging roller, a developing device 12, a transfer unit 13, and a cleaning device 14 having a photoconductor cleaning blade 8 are arranged around the photoconductor 10. The developing device 12 uses polymerization toner manufactured using a polymerization method as toner and attaches the polymerization toner to an electrostatic latent image on the photoconductor 10 using a developing roller 121 as a developer bearer to form a visible image.

The transfer unit 13 includes a transfer belt 17 which is wound and suspended on two roller members of a first belt tension roller 15 and a second belt tension roller 16. The transfer belt 17 is pressed on the circumferential surface of the photoconductor 10 at a transfer position B at which a toner image on the photoconductor 10 is transferred onto a recording sheet P as a recording medium.

Foreign substance such as residual toner or paper powder remaining on the transfer belt 17 after the recording sheet P is separated is scraped by a belt cleaning blade 18 which is disposed in a transfer belt cleaning part C and which comes in contact with the first belt tension roller 15 with the transfer belt 17 interposed therebetween. The image forming section 100 is provided with a toner supply device 20 that supplies new toner to the developing device 12 on the left side of the charging device 11 and the cleaning device 14 in FIG. 3.

The image forming section 100 is provided with a recording sheet conveyor 60 that conveys a recording sheet P sent out of a recording sheet cassette 61 of the recording sheet bank 300 to an ejection stack portion 39 via the transfer position B. The recording sheet conveyor 60 conveys a recording sheet P along a feed path R1 or a manual feed path R2 and a recording sheet conveyance path R. In the recording sheet conveyance path R, a registration roller pair 21 is disposed upstream in the recording sheet conveyance direction from the transfer position B.

On the other hand, a thermal fixing device 22 is disposed downstream in the recording sheet conveyance direction in the recording sheet conveyance path R from the transfer position B. The thermal fixing device 22 pinches a recording sheet P between a heating roller 30 as a heating member and a pressure roller 32 as a pressure member, and performs a heating and pressure fixing operation on the recording sheet.

An ejection bifurcating claw 34, an ejection roller 35, a first pressure roller 36, a second pressure roller 37, and a viscosity applying roller 38 are disposed downstream in the recording sheet conveyance direction from the thermal fixing device 22. An ejection stack portion 39 in which the recording sheet P having an image formed thereon and passing through the thermal fixing device 22 is stacked is also disposed.

The image forming section 100 is provided with a switchback device 42 on the right side in FIG. 1. The switchback device 42 conveys a recording sheet P along a reverse conveyance path R3 bifurcating from the position at which the ejection bifurcating claw 34 is disposed in the recording sheet conveyance path R and a re-conveyance path R4 guiding the recording sheet P passing through the reverse conveyance path R3 to the position of the registration roller pair 21 in the recording sheet conveyance path R again. The reverse conveyance path R3 is provided with a switchback roller pair 43 and the re-conveyance path R4 is provided with plural recording sheet conveyance roller pairs 66.

As illustrated in FIG. 1, the image forming section 100 is provided with a laser writing device 47 on the left side of the developing device 12 in FIG. 3. The laser writing device 47 includes a laser source, a polygon mirror 48 as a scanning rotary polygon mirror, a polygon motor 49, and a scanning optical system such as an fθ lens.

The scanner 200 includes a light source 53, plural mirrors 54, an optical imaging lens 55, and an image sensor 56 such as a CCD image sensor, and the top face thereof is provided with an exposure glass 57. The automatic document feeder 400 is provided with a document setting platen, and an ejection position of an original document is provided with a document stack stage. The automatic document feeder 400 includes plural document conveyance rollers, and an original document is conveyed from the document setting platen to the document stack stage via a reading position on the exposure glass 57 of the scanner 200 by the document conveyance rollers.

The recording sheet bank 300 is provided with plural recording sheet cassettes 61 that contain recording sheets P such as paper sheets as a recording material or OHP films in an overlap manner. Each recording sheet cassette 61 is provided with a call roller 62, a feed roller 63, and a separation roller 64. On the right side of the recording sheet cassettes 61 in FIG. 1, the feed path R1 communicating with the recording sheet conveyance path R of the image forming section 100 is formed. The feed path R1 is also provided with several recording sheet conveyance roller pairs 66 that convey a recording sheet P.

The image forming section 100 is provided with a manual sheet feeder 68 on the right side in FIG. 1. The manual sheet feeder 68 is provided with a manual feed tray 67 so as to be opened and closed, and the manual feed path R2 guiding a recording sheet P set on the manual feed tray 67 to the recording sheet conveyance path R is formed. Similar to the recording sheet cassettes 61, the manual sheet feeder 68 is provided with a call roller 62, a feed roller 63, and a separation roller 64.

Operations of the image forming apparatus 500 will be described below. When copying is carried out using the image forming apparatus 500, a main switch is first turned on and an original document is set on the document setting platen of the automatic document feeder 400. In the case of a book-type original document, the automatic document feeder 400 is opened, the original document is directly set on the exposure glass 57 of the scanner 200, and the automatic document feeder 400 is closed to press the original document.

Thereafter, a start switch is pushed. Then, when the original document is set in the automatic document feeder 400, the original document is moved onto the exposure glass 57 via a document conveyance path using a document conveyance roller and then the scanner 200 is driven. Contents of the original document are read and the original document is discharged onto the document stack stage. On the other hand, when the original document is directly set on the exposure glass 57, the scanner 200 is immediately driven to read contents of the original document. In reading contents of the original document, the scanner 200 irradiates the document face on the exposure glass 57 with light from the light source 53 while moving the light source 53 along the exposure glass 57. Then, the reflected light is guided to the optical imaging lens 55 using plural mirrors 54 and is input to the image sensor 56, and the contents of the original document are read by the image sensor 56.

In the image forming apparatus 500, the photoconductor 10 is rotated in a direction indicated by arrow A in FIG. 1 by a photoconductor drive motor at the same time as reading the contents of the original document. Then, the surface of the photoconductor 10 is first uniformly charged to, for example, −1000 [V] more or less with the charging device 11. Subsequently, the photoconductor 10 is irradiated with a laser beam from the laser writing device 47 based on the contents of the original document read by the scanner 200 to perform a laser writing operation to form an electrostatic latent image on the surface of the photoconductor 10. The surface potential of a part (latent image part) irradiated with the laser beam ranges, for example, 0 [V] to −200 [V]. Thereafter, toner is attached to the electrostatic latent image to form a visible image by the developing device 12.

In the image forming apparatus 500, at the same time as pushing the start switch, a recording sheet P is sent out from the recording sheet cassette 61 corresponding to a selected size among the plural recording sheet cassettes 61 of the recording sheet bank 300 by the call roller 62. The sent out recording sheet P is separated by the feed roller 63 and the separation roller 64 sheet by sheet, and one sheet is guided to the feed path R1 and is guided to the recording sheet conveyance path R by the recording sheet conveyance roller pair 66. The recording sheet P conveyed to the recording sheet conveyance path R comes in contact with the registration roller pair 21 and is stopped.

When the manual sheet feeder 68 is used, the manual feed tray 67 is opened and a recording sheet P is set thereon. In this case, only one recording sheet P set on the manual feed tray 67 is conveyed to the manual feed path R2 by the call roller 62, the feed roller 63, and the separation roller 64 and is guided to the recording sheet conveyance path R by the recording sheet conveyance roller pair 66. The recording sheet P guided to the recording sheet conveyance path R comes in contact with the registration roller pair 21 and is stopped. In this way, the recording sheet P stopped by the registration roller pair 21 is conveyed to the transfer position B by the registration roller pair 21 of which the rotation is started in synchronization with the timing at which the tip of the visualized toner image on the photoconductor 10 enters the transfer position B.

The toner image on the photoconductor 10 is transferred onto the recording sheet P conveyed to the transfer position B by the transfer unit 13 and the toner image is borne on the surface thereof. The residual toner remaining on the surface of the photoconductor 10 after the transferring is removed by the cleaning device 14, and the residual potential on the photoconductor 10 is removed by the neutralization lamp 9. Since the residual potential is removed, the surface potential is averaged to a reference potential of 0 [V] to −150 [V] and the photoconductor waits for formation of a next image which is started from the charging device 11.

On the other hand, the recording sheet P having borne the toner image at the transfer position B is conveyed by the transfer belt 17 and enters the thermal fixing device 22. The toner image on the recording sheet P is fixed by heat and pressure applied while being conveyed between the heating roller 30 and the pressure roller 32. Thereafter, the recording sheet P can have viscosity applied by the ejection roller 35, the first pressure roller 36, the second pressure roller 37, and the viscosity applying roller 38, is ejected onto the ejection stack portion 39 from the sheet ejection port 40, and is stacked thereon.

When an image is formed on both faces of a recording sheet P, the ejection bifurcating claw 34 is switched and then the recording sheet P is conveyed from the recording sheet conveyance path R to the reverse conveyance path R3 after a toner image has been transferred and fixed to one face of the recording sheet P. The recording sheet P conveyed to the reverse conveyance path R3 is conveyed into the switchback position 44 by the recording sheet conveyance roller pair 66, is switched back by the switchback roller pair 43, is conveyed to the re-conveyance path R4, and is guided to the recording sheet conveyance path R again by the recording sheet conveyance roller pair 66. Then, a toner image is transferred onto the opposite face of the recording sheet P passing through the re-conveyance path R4.

As illustrated in FIG. 1, the image forming apparatus 500 is an in-body sheet ejection image forming apparatus in which the electric unit 800 is disposed above the in-body sheet ejection part 41 onto which a recording sheet P having an image formed thereon by the image forming section 100 is ejected from the sheet ejection port 40 as an outlet and the image forming section 100 is disposed below the in-body sheet ejection part. The recording sheet P having an image is formed is ejected onto the in-body sheet ejection part 41 from the sheet ejection port 40 and is stacked on the ejection stack portion 39.

Features of the image forming apparatus 500 according to this embodiment will be described below. As illustrated in FIG. 1, in the image forming apparatus 500, the electric unit 800 having a box-shaped electric box 1 containing a printed circuit board 2 is disposed between the in-body sheet ejection part 41 and the scanner 200. The sound absorbing device 600 using a Helmholtz resonator is mounted in the electric box 1.

The printed circuit board 2 is fixed to an inner wall face of the electric box 1 and the printed circuit board 2 is surrounded with the electric box 1. Accordingly, it is possible to prevent circuits formed on the printed circuit board 2 from being affected by noise.

Figure 4A:
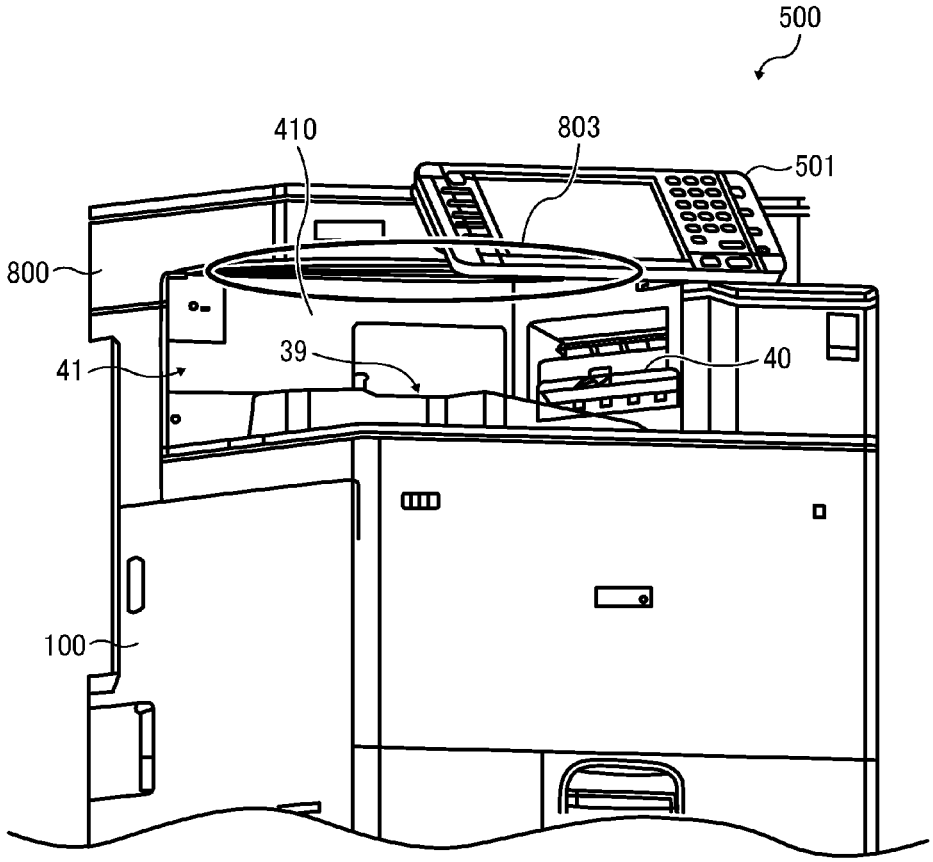
FIGS. 4A and 4B are diagrams illustrating an in-body sheet ejection part according to an embodiment of the present disclosure, where
Figure 4B:
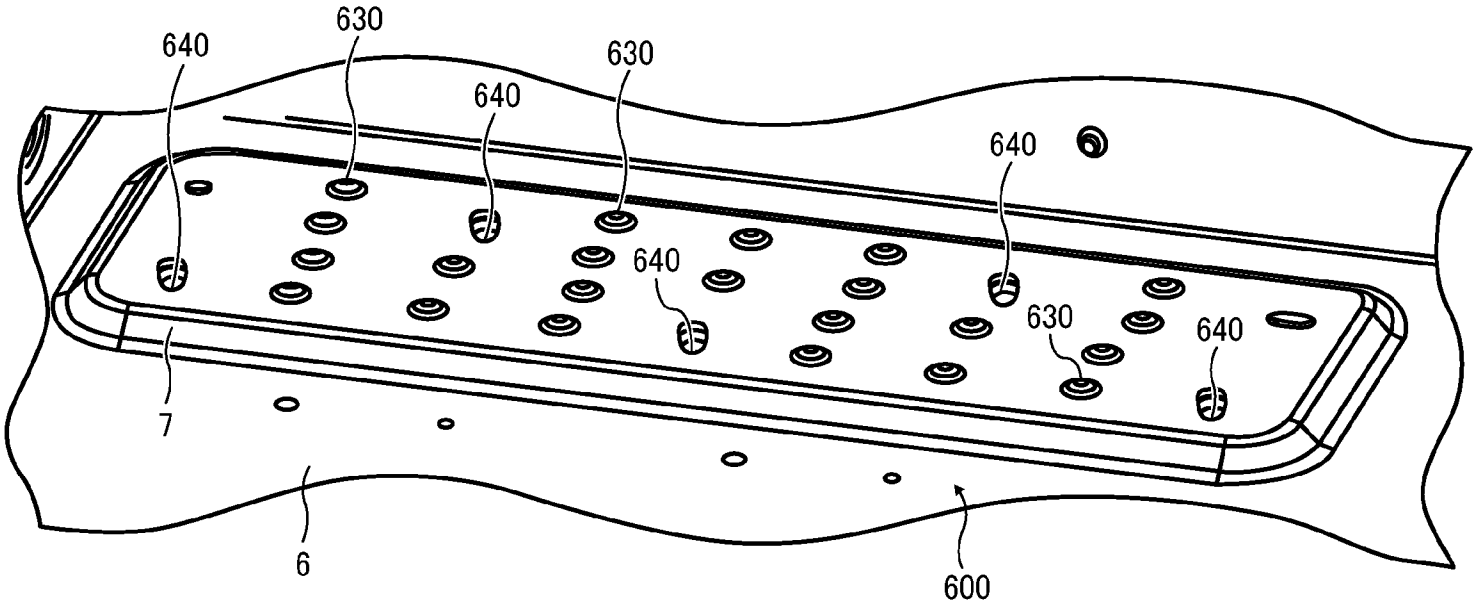

FIGS. 4A and 4B are diagrams illustrating the in-body sheet ejection part 41. FIG. 4A is a perspective view of the vicinity of the in-body sheet ejection part 41 in the image forming apparatus 500 and FIG. 4B is a perspective view of the sound absorbing device 600 when an electric unit bottom face 803 which is the bottom face of the electric unit 800 and which forms the top face of the in-body sheet ejection part 41 is viewed from the downside.

Figure 5:
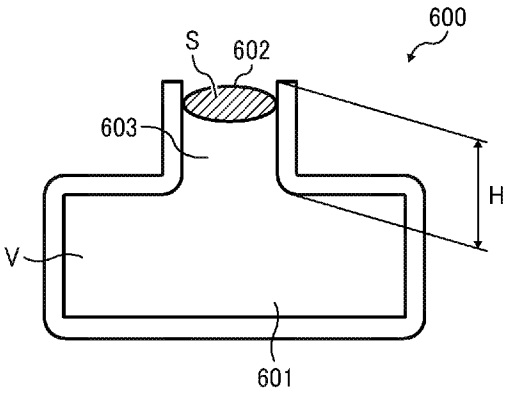
FIG. 5 is a schematic view of the sound absorbing device using a Helmholtz resonator according to an embodiment of the present disclosure.

The sound absorbing device included in the image forming apparatus 500 according to this embodiment is a sound absorbing device 600 using a Helmholtz resonator. FIG. 5 is a schematic view of the sound absorbing device 600 using a Helmholtz resonator. As illustrated in FIG. 5, the Helmholtz resonator has a vessel shape having a narrow neck, includes a cavity 601 having a certain volume and a communication portion 603 smaller than the cavity, and absorbs sound of a specific frequency entering the communication portion 603. When the volume of the cavity 601 is defined by "V", the opening area of an opening 602 of the communication portion 603 is defined by "S", the length of the communication portion 603 is defined by "H", the sound speed is defined by "c", and the sound absorption frequency of the sound absorbing device 600 is defined by "f", Equation 1 is established.

$$f = \frac{c}{2\pi}\sqrt{\frac{S}{V(H+\Delta r)}} \quad \text{[Equation 1]}$$

(Δr: open end correction)

"Δr" in Equation 1 denotes an open end correction and "Δr=0.6r" is generally used where "r" denotes the radius of a circle when a cross-section of the communication portion 603 is the circle. As shown in Equation 1, the frequency of sound absorbed by the sound absorbing device 600 can be calculated using the volume V of the cavity 601, the length H of the communication portion 603, and the opening area S of the communication portion 603.

A variety of sound such as driving sound of drive motors transmitting rotational driving forces to various rollers, moving sound of moving members such as various rollers, and rotational sound of the polygon mirror 48 of the laser writing device 47 is generated in the image forming section 100. This sound may propagate to the outside of the image forming apparatus 500 and may serve as noise giving discomfort to a user. The sound generated in the image forming section 100 is prevented from propagating to the outside by members such as an outer cover partitioning the inside of the image forming apparatus 500 from the outside of the image forming apparatus 500. However, the sheet ejection port 40 is a place from which a recording sheet P is ejected and thus is necessarily an opening of the image forming section 100. Since there is no cover, sound generated in the image forming section 100 leaks from the sheet ejection port 40 and causes noise.

For this problem, it can be considered that a sound absorbing device using a Helmholtz resonator is disposed in the recording sheet conveyance path R in the vicinity of the sheet ejection port 40. However, since the image forming apparatus is a precise machine having a lot of components, there are a lot of contents and thus a space for disposing the Helmholtz resonator in the recording sheet conveyance path R in the vicinity of the sheet ejection port 40 is small. Even when a space is secured, there is a problem in that the Helmholtz resonator cannot be disposed at a position effective for preventing sound from propagating to a user position or the number of Helmholtz resonators which can be disposed at the position is small, thereby not satisfactorily enhancing a sound absorption effect.

On the contrary, in the image forming apparatus 500 according to this embodiment, the sound absorbing device 600 that can absorb sound propagating from the sheet ejection port 40 to the in-body sheet ejection part 41 is disposed on the electric unit bottom face 803 which forms the top face of the in-body sheet ejection part 41. Accordingly, sound leaking from the sheet ejection port 40 to the in-body sheet ejection part 41 can be absorbed by the sound absorbing device 600 before being sensed by a user, and it is thus possible to prevent sound leaking from the sheet ejection port 40 from becoming noise.

As illustrated in FIGS. 4A and 4B, holes 630 are formed in an electric box bottom frame 6 which is a structure forming the electric unit bottom face 803 serving as the top face of the in-body sheet ejection part 41. The holes 630 correspond to the communication portion 603 described with reference to FIG. 5.

Figure 6:
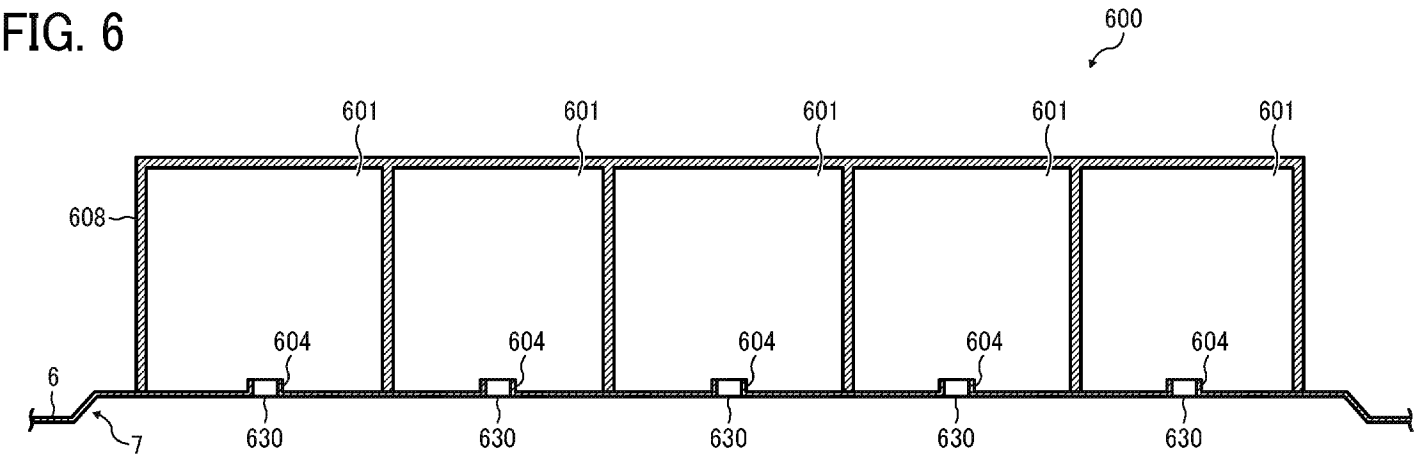
FIG. 6 is a cross-sectional view of a sound absorbing device according to an embodiment of the present disclosure.

FIG. 6 is a cross-sectional view of the sound absorbing device 600 according to this embodiment. As illustrated in FIG. 6, a flange portion 604 as an upright portion rising upright in the normal direction of the top face of the electric box bottom frame 6 to the inside of the cavity 601 is formed by burring on the electric box bottom frame 6 formed of a metal sheet. The inside of the flange portion 604 is a hole 630 (the communication portion 603) with a sectional area "S" and a length "H".

The burring is a processing method of forming a pilot hole in a plate member, inserting a punch with a diameter larger than the pilot hole into the pilot hole, and forming a short pipe around the opening while widening the edge of the pilot hole. By forming the holes 630 using the burring process, it is possible to form the holes 630 without separately providing a member for forming the holes 630 in the electric box bottom frame 6 forming a part of the wall face of the cavity 601.

In the burring, as the difference between the diameter of the punch and the diameter of the pilot hole becomes larger, the length of the flange portion 604 becomes larger and the length "H" of the hole 630 becomes larger. By increasing the length "H" in Equation 1, the frequency of sound to be absorbed can be lowered. Accordingly, in the configuration in which the holes 630 are formed by the burring, a Helmholtz resonator absorbing sound of a lower frequency can be formed without changing the opening area "S" of the hole 630 by decreasing the diameter of the pilot hole in comparison with the diameter of the punch.

A resonance box 608 forming the cavity 601 is disposed on the top face of the position at which the hole 630 is formed in the electric box bottom frame 6. The resonance box 608 is fixed to the electric box bottom frame 6 with a fastening screw 640 to form the sound absorbing device 600 which is a Helmholtz resonator. The fixation of the resonance box 608 to the electric box bottom frame 6 is not limited to the screw, but may be performed using another fastener such as a double-sided tape or a sealant. The fastening screw 640 may be fastened from any of the bottom side or the top side of the electric box bottom frame 6. When a screw tip is exposed as when the tip of the fastening screw 640 projects from the bottom of the electric box bottom frame 6, it is preferable that a screw having a rounded tip in which a tip face is rounded be used.

The resonance box 608 is formed of a resin material. Since the resin material is a material which can be more easily processed than a metal material, the volume of the cavity 601 can be secured with high precision while maintaining sealability in comparison with a configuration in which all the wall faces of the cavity 601 are formed of the metal material. By securing the volume of the cavity 601 with high precision, it is possible to absorb sound of a desired frequency.

By forming the hole 630 in the electric box bottom frame 6 which is a frame of the electric box 1 and attaching the resonance box 608 to form a Helmholtz resonator, it is possible to achieve a decrease in the number of components and space saving. The sound absorbing device 600 illustrated in FIGS. 1 and 6 includes plural combinations of the cavity 601 and the hole 630 to form plural Helmholtz resonators. In the configuration having plural Helmholtz resonators, it is possible to absorb sound of different frequencies by setting the absorption frequencies of the Helmholtz resonators to be different from each other.

As illustrated in FIGS. 4B and 6, the image forming apparatus 500 is provided with a recessed portion 7 which is formed by making the electric box bottom frame 6 concave to the inside of the electric box 1. Accordingly, sound propagating from the sheet ejection port 40 to the bottom face of the electric box bottom frame 6 is rebounded from the recessed portion 7 and easily goes into the holes 630 of the sound absorbing device 600. By disposing the recessed portion 7, the electric box bottom frame 6 does not have a simple panel shape but has a three-dimensional shape in which a step is formed in a bent shape or a throttled shape in a panel-like metal sheet. In this way, since the strength of the electric box bottom frame 6 is enhanced and is not easily deformed by having the three-dimensional shape, sealability of the electric box bottom frame 6 and the resonance box 608 does not easily decrease.

The recessed portion 7 has a shape which is recessed to a side spaced apart from the in-body sheet ejection part 41 with respect to the surrounding of the electric box bottom frame 6. Accordingly, a projecting component such as the fastening screw 640 cannot interfere with a user. Since the strength is improved due to dimples and bending shapes for forming the recessed portion, the sealability of the electric box bottom frame 6 and the resonance box 608 can be easily maintained. Since a wall is formed around the sound absorbing device 600, sound can be easily gathered in the holes 630 of the sound absorbing device 600 and sound can easily go into the holes 630, thereby improving a sound absorption effect.

The hole 630 may be simple hole formed by punching the plate-shaped electric box bottom frame 6. When the electric box bottom frame 6 is a metal sheet, the length "H" of the communication portion 603 can be gained by the burring. Accordingly, when the frequencies of sound to be absorbed are the same, the opening area S of the communication portion 603 can be set to be relatively large, thereby enhancing a sound absorption effect. When the hole 630 is formed by the burring, the shape projecting by the burring is made to be directed to the top face of the electric box bottom frame 6, that is, the inside of the electric box 1, as illustrated in FIG. 6. Accordingly, the edge of the metal sheet due to the burring is not conspicuous, thereby enhancing safety.

Figure 7:
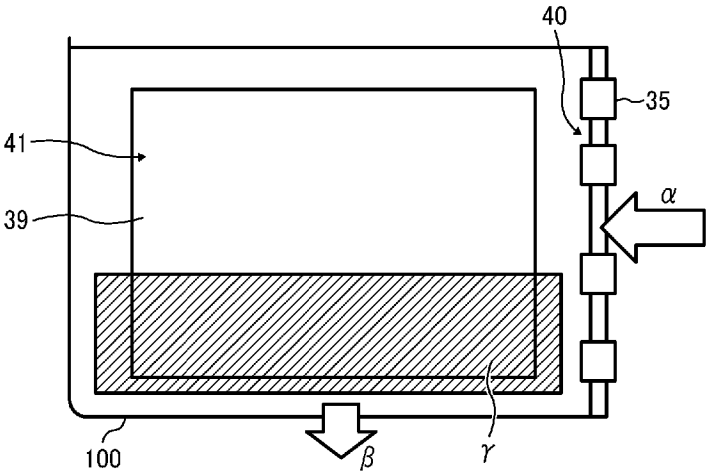
FIG. 7 is a top view of an in-body sheet ejection part according to an embodiment of the present disclosure.

FIG. 7 is a top view of the in-body sheet ejection part 41. An arrow $\alpha$ in FIG. 7 indicates a sheet ejection direction, and an arrow $\beta$ in FIG. 7 indicates the front side of the image forming apparatus 500, the direction indicated by the arrow $\beta$ is the front side of the drawing surface of FIG. 1. In the image forming apparatus 500 according to this embodiment, the sound absorbing device 600 is disposed in the electric box bottom frame 6 located above the region on the front side of the in-body sheet ejection part 41 which is indicated by "$\gamma$", in FIG. 7.

A user is assumed to stand on the front side of the image forming apparatus 500 to operate a control panel 501 or to recover a recording sheet P to be ejected. Among sound leaking from the sheet ejection port 40, most sound propagating to the position of the user standing on the front side of the image forming apparatus 500 via the in-body sheet ejection part 41 passes through the region indicated by $\gamma$ in FIG. 7. By disposing the sound absorbing device 600 above the region $\gamma$ through which the sound directed to the user passes, it is possible to effectively prevent sound leaking from the sheet ejection port 40 from propagating to the position of the user. By disposing the sound absorbing device 600 on the wall face of the in-body sheet ejection part 41 which is a place closest to the user, it is possible to effectively suppress discomfort of the user.

As illustrated in FIGS. 1 and 6, the image forming apparatus 500 has a configuration in which the sound absorbing device 600 is disposed such that the resonance box 608 is located inside the electric box 1 and at least a part (the entire sound absorbing device 600 in this embodiment) of the sound absorbing device 600 is disposed in the electric box 1. Accordingly, it is possible to suppress an increase in size of the image forming apparatus 500 due to provision of the sound absorbing device 600.

The electric box 1 is a member having a substantially rectangular parallelepiped box shape which is formed of a metal plate. Metal can suppress transmission sound. Accordingly, by causing the surface of the electric box 1 formed of metal to face the in-body sheet ejection part 41, it is possible to suppress transmission of sound and to suppress leakage of sound even when sound leaking from the sheet ejection port 40 propagates to the surface of the electric box 1 not provided with the sound absorbing device 600. Since sound is reflected by the surface of the electric box 1 formed of metal, it is possible to promote sound to be incident on the holes 630 of the sound absorbing device 600. The electric box 1 is not limited to a structure in which six faces of a rectangular parallelepiped are surrounded with wall faces, but may have a structure in a rectangular parallelepiped space is formed by a framework or a structure in which holes are formed in the wall faces.

As illustrated in FIG. 1, in the image forming apparatus 500, the holes 630 are formed using a part of the walls of the electric box 1 as a communication portion forming member. By disposing the holes 630 in the electric box 1 in this way, it is not necessary to separately dispose the communication portion forming member and it is thus possible to achieve a decrease in the number of components, thereby suppressing costs for the sound absorbing device 600.

The electric box 1 according to this embodiment includes a printed circuit board 2 inside the housing thereof, and the printed circuit board 2 is disposed with a certain distance from the inner wall face of the electric box 1 such that a short circuit does not occur with the housing of the electric box 1 made of metal. When it is assumed that the housing having a shape along the printed circuit board 2 is formed so as to form a space in the electric box 1 as little as possible, an increase in manufacturing cost is caused. Accordingly, the shape of the housing of the electric box 1 is set to a substantially rectangular parallelepiped box shape and a gap as a spatial margin is present therein. By disposing at least a part of the sound absorbing device 600 in the gap, it is possible to prevent sound generated in the apparatus from propagating from the ejection port to the outside to serve as noise and to suppress an increase in size of the image forming apparatus 500.

The method of utilizing the gap in the housing of the electric box 1 is not limited to the method of disposing the constituent member of the sound absorbing device 600 in the electric box. For example, even when the constituent member of the sound absorbing device 600 is attached to the outside of the housing of the electric box 1, the fastening members used for this attachment may be disposed in the gap in the housing of the electric box 1. In this case, it is not necessary to separately dispose a space for the fastening member and it is thus possible to suppress an increase in size of the apparatus due to addition of the sound absorbing device 600.

Since sound leaking from the sheet ejection port 40 includes operation sound of various members in the image forming section 100 in addition to sliding sound of a sheet, sound having a frequency other than a specific peak sound also leaks. Accordingly, since it is difficult to dispose the sound absorbing device 600 corresponding to all frequencies, the sound absorbing device 600 corresponding to frequencies making a person acoustically discomfort, for example, frequencies of 1000 [Hz] to 1500 [Hz], is provided. Accordingly, it is possible to efficiently prevent sound leaking from the sheet ejection port 40 from serving as noise. Since the holes 630 of the sound absorbing device 600 are opened to the in-body sheet ejection part 41, sound reaching the in-body sheet ejection part 41 can easily enter the holes 630 and the sound can be efficiently absorbed.

In the image forming apparatus 500 according to this embodiment, as illustrated in FIG. 7, the sound absorbing device 600 is disposed on only the front side of the electric unit bottom face 803. The sound absorbing device 600 is not limited to this arrangement, but the sound absorbing device 600 may be disposed in the entire area of the bottom face of the electric box bottom frame 6 forming a part of the electric unit bottom face 803 when a spatial margin is present in the housing of the electric box 1. The electric box 1 has a larger spatial margin in the housing thereof than the other structures and plural sound absorbing devices 600 including Helmholtz resonators can be disposed therein. By providing plural sound absorbing devices 600, it is possible to form Helmholtz resonators corresponding to different frequencies and thus to achieve improvement in a sound absorption effect.

The position at which the electric box 1 including the sound absorbing device 600 is disposed is not limited to the position of the upper wall face forming the in-body sheet ejection part 41. By disposing the electric box 1 at a position of a wall face forming the in-body sheet ejection part 41 such as a scanner support side plate 410 and disposing the sound absorbing device 600 in the wall face, it is possible to prevent sound propagating from the sheet ejection port 40 to the outside from serving as noise.

Since plural conveyance rollers or roller driving mechanisms driving the conveyance rollers are disposed in the recording sheet conveyance path R in the vicinity of the sheet ejection port 40, a spatial margin for disposing the sound absorbing device 600 is not present therein. When the sound absorbing device 600 is disposed in the recording sheet conveyance path R, a space for disposing the conveyance mechanism is enlarged to cause an increase in size of the image forming apparatus 500 as a whole. Even when the space for disposing the sound absorbing device 600 is secured, there is a problem in that the sound absorbing device 600 cannot be disposed at a position effective for a user or the number of sound absorbing devices which can be disposed at the position is small, thereby not satisfactorily enhancing a sound absorption effect.

On the contrary, in the image forming apparatus 500 according to this embodiment, the electric box 1 is disposed in a structure forming the in-body sheet ejection part 41 and the sound absorbing device 600 is disposed in the electric box 1. The sizes in the front-rear direction, the right-left direction, and the height direction of the housing the electric box 1 are determined by the sizes in the directions of the printed circuit board 2. Since a lot of members does not have to be disposed in the electric box 1 unlike the surrounding of the recording sheet conveyance path R, a spatial margin is present in the housing thereof. By disposing the electric box 1 having such a spatial margin in the structure forming the in-body sheet ejection part 41 and disposing the sound absorbing device 600 in the electric box 1, it is possible to prevent sound propagating from the sheet ejection port 40 to the outside from serving as noise.

In the image forming apparatus 500, the electric unit 800 is disposed above the in-body sheet ejection part 41 and the sound absorbing device 600 is disposed on the electric unit bottom face 803 which is the bottom face thereof. For example, in a configuration in which the electric unit 800 is disposed in the ejection stack portion 39 located in the lower part of the in-body sheet ejection part 41 and the sound absorbing device 600 is disposed on the top face thereof, when a recording sheet P is stacked, the recording sheet P isolates the sound absorbing device 600 and the sheet ejection port 40 from each other and thus the sound absorption effect is reduced. On the contrary, in the image forming apparatus 500 according to this embodiment, the electric unit 800 is disposed above the in-body sheet ejection part 41 and the sound absorbing device 600 is disposed in the electric box 1 of the electric unit 800. Accordingly, even when a recording sheet P is stacked, the recording sheet P does not isolate the sheet ejection port 40 and the sound absorbing device 600 and thus the sound absorption effect can be maintained.

An electric board such as the printed circuit board 2 is disposed in the electric board containing box such as the electric box 1, and a certain gap is disposed between an electric component disposed on the electric board and the housing of the electric board containing box so as to prevent a short circuit therebetween. From the viewpoint of operability for facilitating access to the electric board therein at the time of assembly or maintenance or replacement, a certain gap is disposed in the electric board containing box. In the image forming apparatus 500 according to the present disclosure, the electric box 1 which is the electric board containing box having such a gap is disposed in the electric unit 800 forming the top face of the in-body sheet ejection part 41 and the gap in the electric box 1 is used to attach the sound absorbing device 600. Accordingly, it is possible to suppress an increase in size of the apparatus and to prevent sound leaking from the sheet ejection port 40 from propagating to the outside to serve as noise.

From the viewpoint of preventing a short circuit, even when the resonance box 608 as a member to be added to dispose the sound absorbing device 600 is formed of an insulator such as a resin and the gap is filled, it is also possible to prevent a short circuit. Even when a harness member electrically connecting the printed circuit board 2 to another member comes in contact, it is possible to prevent noise from occurring in an electric signal transmitted and received via the hardness member. Accordingly, since the resonance box 608 can be disposed up to a position close to the printed circuit board 2 in the gap in the electric box 1, it is possible to effectively utilize the gap in the electric box 1.

From the viewpoint of operability, it is possible to achieve maintenance of operability by finally disposing the resonance box 608 among the components of the electric box 1. By disposing a shape regulating the path of the hardness member in the resonance box 608, it is possible to achieve improvement in operability. The electric components such as the printed circuit board 2 in the electric box 1 may serves as a noise source. On the other hand, by setting the hole diameter of the communication portion 603 of the sound absorbing device 600 to be satisfactorily small, it is possible to prevent noise generated in the electric components from affecting the outside of the apparatus and to prevent noise generated outside the apparatus from affecting the electric components in the electric box 1. As a reference for preventing radiation of GHz-class noise, the hole diameter of the communication portion 603 can be preferably set to "ϕ5 [mm]" or less.

[Variation]

Figure 8:
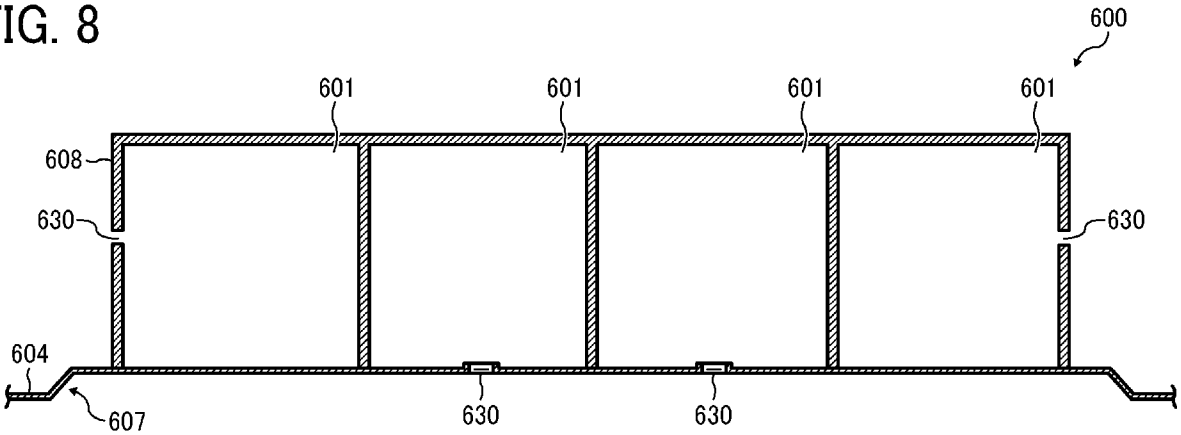
FIG. 8 is a cross-sectional view of a sound absorbing device according to a variation of the present disclosure.

FIG. 8 is a cross-sectional view of a sound absorbing device 600 of an image forming apparatus 500 according to a variation of the present disclosure. This image forming apparatus 500 according to the variation is the same as the image forming apparatus 500 according to the above-mentioned variation illustrated in FIG. 2, except that the positions of some of plural holes 630 in the sound absorbing device 600 are different. Accordingly, description of the same configuration will not be repeated but the difference will be described.

As illustrated in FIG. 8, in the sound absorbing device 600 according to the variation, the holes 630 causing some cavities 601 of the plural cavities 601 to communicate with the outside are disposed in a scanner bottom frame 604 and the holes 630 of the other cavities 601 are disposed in the side wall of a resonance box 608. In this variation, the sound absorption frequency of the Helmholtz resonators formed by the cavities 601 having the holes 630 formed in the scanner bottom frame 604 is matched with the frequency of sound leaking from the sheet ejection port 40. On the other hand, the sound absorption frequency of the Helmholtz resonators formed by the cavities 601 having the holes 630 formed in the side wall of the resonance box 608 is matched with the frequency of sound generated in the scanner 200. Accordingly, in the configuration according to the variation, by using a single sound absorbing device 600, it is possible not only to prevent sound leaking from the sheet ejection port 40 from serving as noise but also to prevent sound generated in the scanner 200 from serving as noise.

Figure 9A:
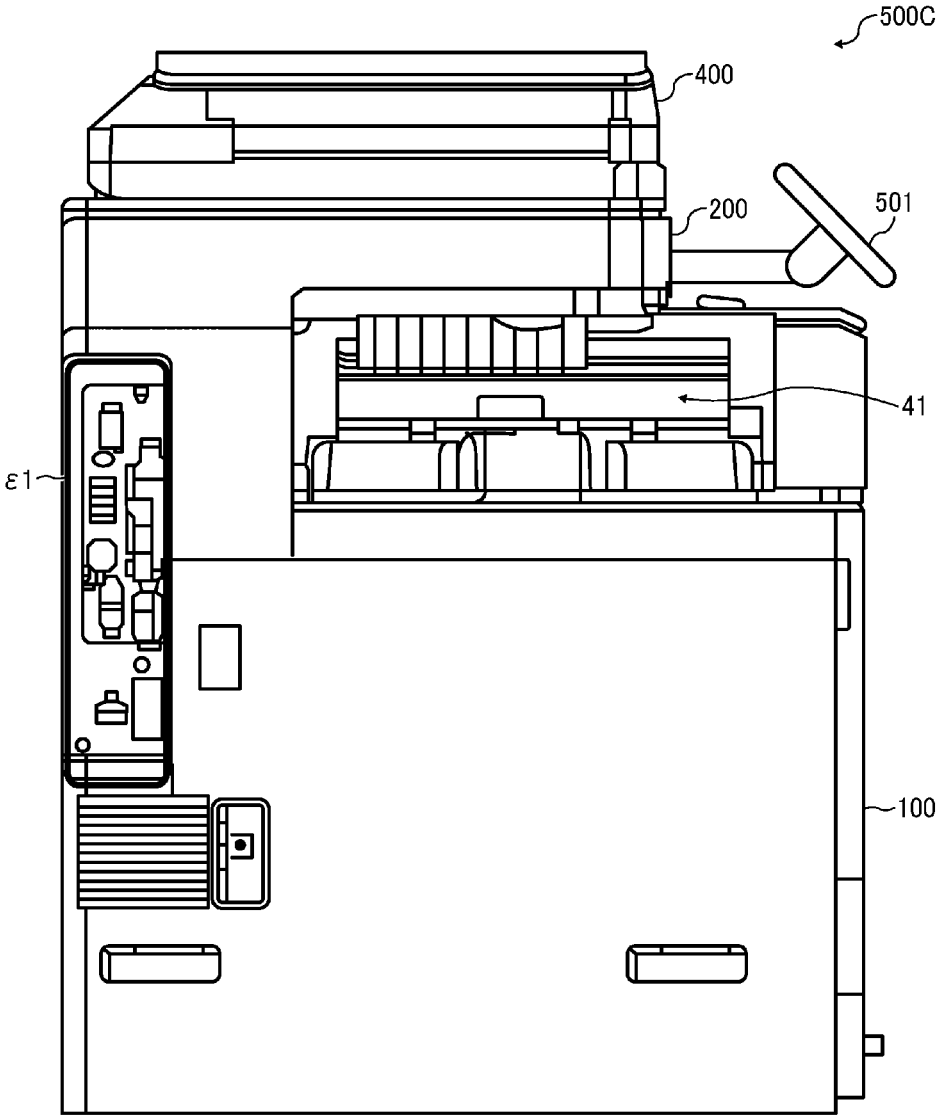
FIGS. 9A and 9B are diagrams illustrating a dimensional difference from an image forming apparatus according to a comparative example, where
Figure 9B:
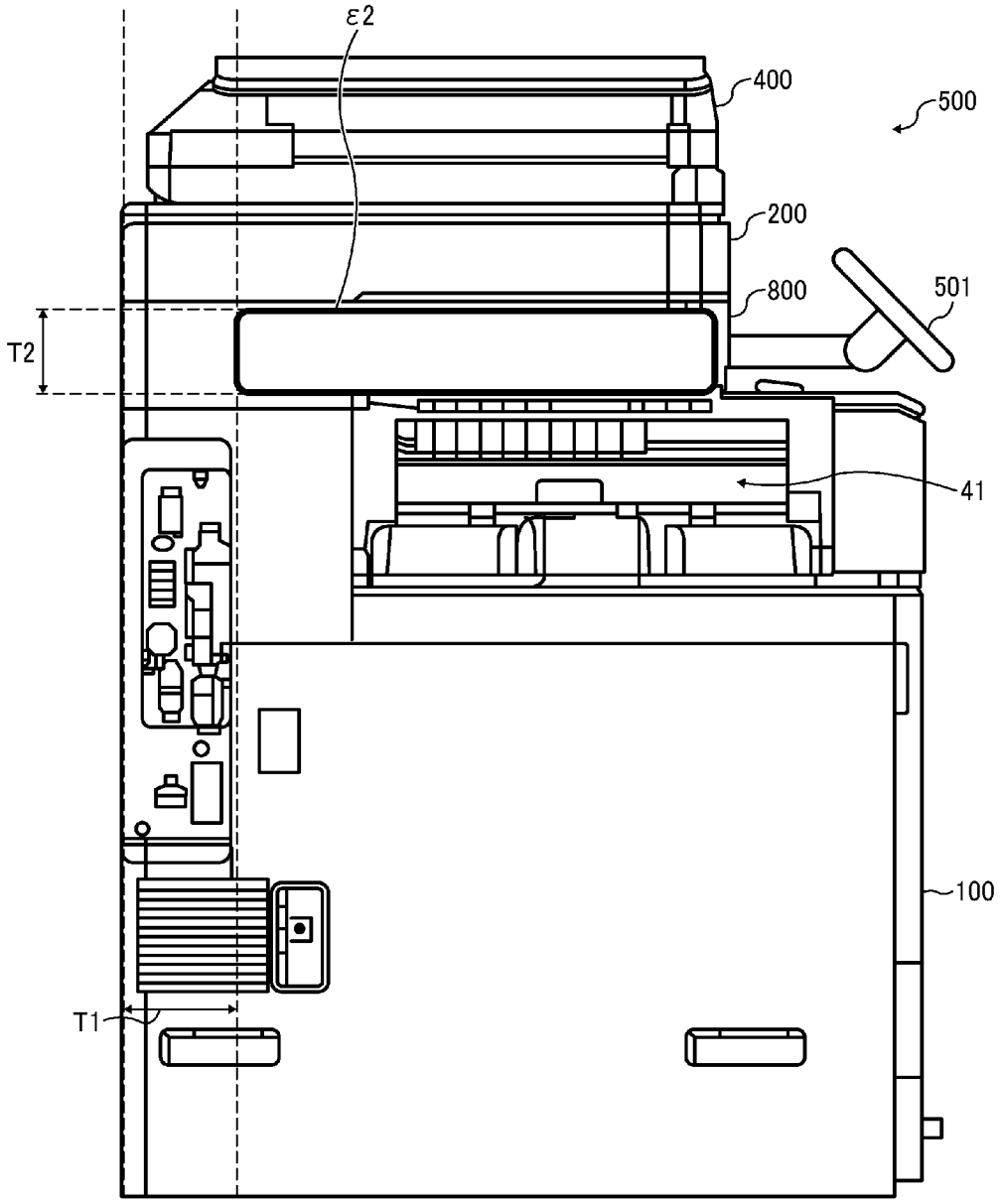

Advantages due to the arrangement of the electric unit 800 including the electric box 1 between the in-body sheet ejection part 41 and the scanner 200 will be described below. FIGS. 9A and 9B are diagrams illustrating a difference in size between an image forming apparatus 500C according to a comparative example and the image forming apparatus 500 according to this embodiment. FIG. 9A is a left side view of the image forming apparatus 500C according to the comparative example, which corresponds to a side view of the image forming apparatus 500 viewed from the left side of FIG. 1. FIG. 9B is a diagram illustrating a virtual apparatus in which the electric unit 800 of the image forming apparatus 500 according to this embodiment is added to the image forming apparatus 500C according to the comparative example. The term "ε1" in FIG. 9A indicates the position of the electric board containing box (the electric box 1) in the image forming apparatus 500C according to the comparative example, and "ε2" in FIG. 9B indicates the position of the electric board containing box in the image forming apparatus 500 according to this embodiment.

In the image forming apparatus 500C according to the comparative example, as indicated by "ε1" in FIG. 9A, the electric board containing box is generally disposed on the rear side of the image forming apparatus 500C. However, space saving is recently required for the image forming apparatus and this requirement is strong particularly for a desktop type which is placed on a desk. An image forming apparatus having a small occupied area is desirable so as not to occupy a large space on the desk. In the configuration according to the comparative example, the thickness of the electric board containing box indicated by T1 in FIG. 9B causes an increase in size in the front-rear direction and contributes to an increase in occupied area of the image forming apparatus.

On the contrary, in the image forming apparatus 500 according to this embodiment, as indicated by "ε2" in FIG. 9B, the electric board containing box is disposed above the in-body sheet ejection part 41 (between the scanner 200 and the in-body sheet ejection part 41). Accordingly, the thickness of the electric board containing box indicated by T2 in FIG. 9B causes an increase in size in the up-down direction of the image forming apparatus. However, the size in the front-rear direction indicated by T1 in FIG. 9B can be reduced in comparison with that in the comparative example and it is thus possible to decrease the occupied area of the image forming apparatus.

Figure 10:
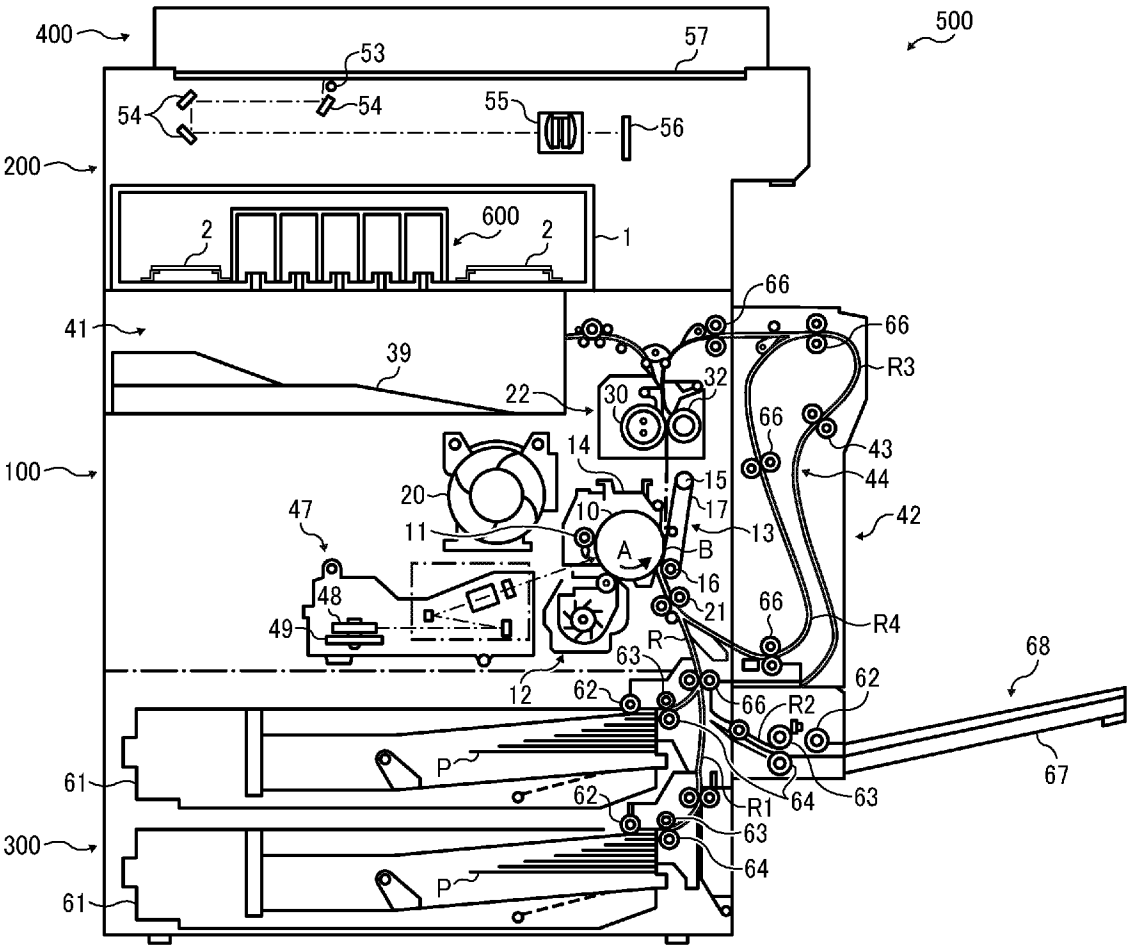
FIG. 10 is a schematic view of an image forming apparatus in which an electric box is disposed in a housing of a scanner according to an embodiment of the present disclosure.

Advantages of the configuration in which the electric unit 800 and the scanner 200 are separately provided in the configuration in which the electric unit 800 including the electric box 1 is disposed between the in-body sheet ejection part 41 and the scanner 200 will be described below. FIG. 10 is a schematic view of the image forming apparatus 500 in which the electric box 1 is disposed in the housing of the scanner 200. In the image forming apparatus 500 illustrated in FIG. 10, since the sound absorbing device 600 is disposed in the electric box 1 similarly to the image forming apparatus 500 illustrated in FIG. 1, it is possible to prevent sound leaking from the sheet ejection port 40 from serving as noise and to suppress an increase in size of the image forming apparatus 500 due to addition of the sound absorbing device 600. By disposing the electric box 1 above the in-body sheet ejection part 41, it is possible to achieve a decrease in occupied area in comparison with that of the image forming apparatus 500 according to the comparative example, which is described with reference to FIGS. 9A and 9B.

However, when the electric box 1 is incorporated into the scanner 200, it is difficult to commonize the image forming apparatus including the scanner 200 and the printer including only the image forming section 100 without including the scanner 200. The reason is as follows. That is, since the electric box 1 is a controller for controlling the drive units of the image forming section 100, it is not possible to form an image without using the electric box. However, in the image forming apparatus 500 illustrated in FIG. 10, when the scanner 200 is separated from the image forming section 100 in order to construct the image forming apparatus including only the image forming function, the electric box 1 in the scanner 200 is also separated. However, the image forming section 100 cannot be activated without using the electric box 1. Accordingly, in the image forming apparatus 500 illustrated in FIG. 10, it is difficult to commonize the printer not including the scanner 200 with the image forming section 100.

Figure 11:
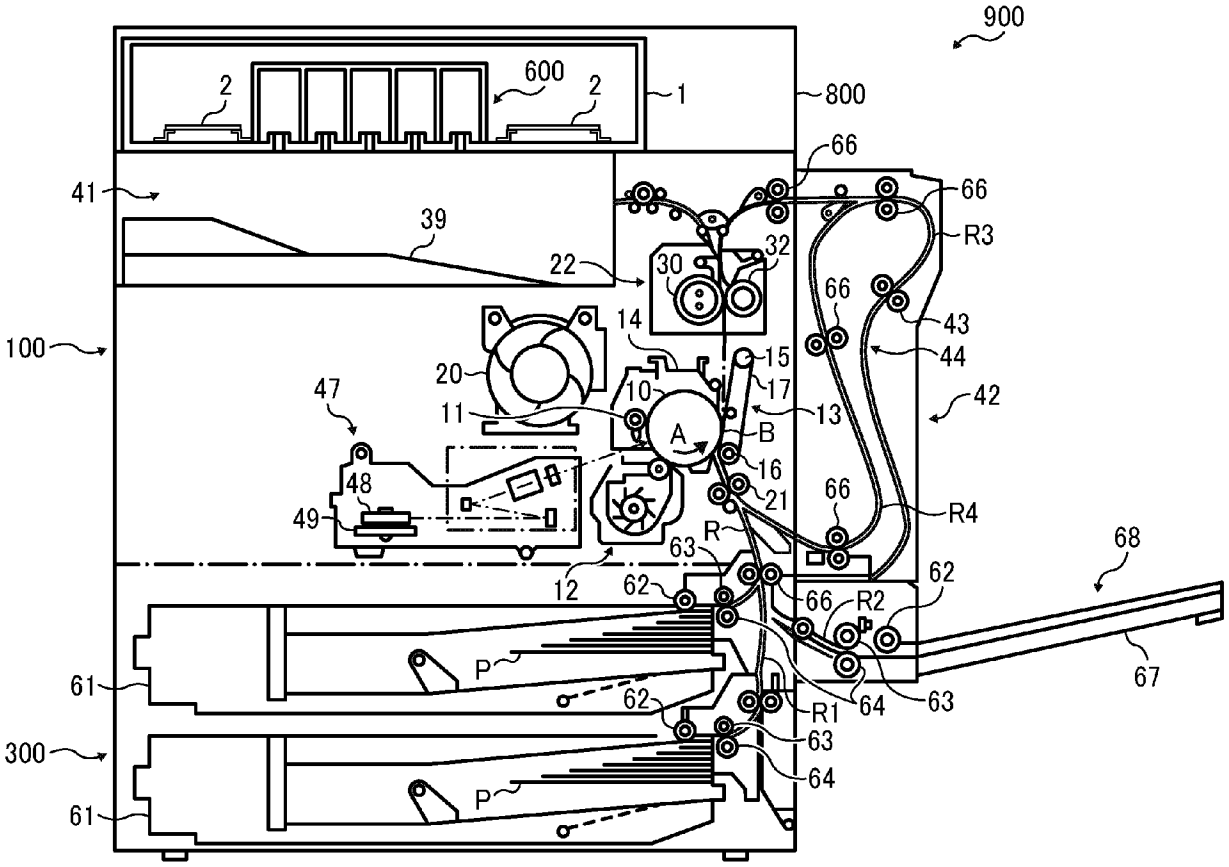
FIG. 11 is a printer including an image forming section common to the image forming apparatus illustrated in FIG. 1 according to an embodiment of the present disclosure.

On the contrary, the image forming apparatus 500 according to this embodiment illustrated in FIG. 1 has a configuration in which the electric unit 800 and the scanner 200 are separately disposed. In the image forming apparatus 500, the scanner 200 can be independently separated from the electric unit 800, and a printer 900 not including the scanner 200 illustrated in FIG. 11 can be constructed by releasing fasteners such as screws and separating the scanner 200. As in the image forming apparatus 500 illustrated in FIG. 1, by disposing the electric unit 800 including the electric box 1 separately from the scanner 200, it is easy to commonize the image forming apparatus with the image forming section of the printer.

Since the electric unit 800 separate from the scanner 200 is disposed between the image forming section 100 and the scanner 200, it is possible to prevent vibration due to driving of the image forming section 100 from propagating to the scanner 200. Accordingly, it is possible to suppress occurrence of noise in reading an original document in the scanner 200.

As in the image forming apparatus 500 illustrated in FIG. 10, when the electric box 1 is disposed in the housing of the scanner 200 and the bottom face of the housing forms the top face of the in-body sheet ejection part 41, a recording sheet P ejected from the sheet ejection port 40 may come in contact with the bottom face of the housing of the scanner 200. When the recording sheet P comes in contact with the bottom face of the scanner 200 in this way, there is a possibility that vibration will occur and an abnormal image such as a shock jitter will be generated. On the other hand, by disposing the electric unit 800 separate from the scanner 200 between the in-body sheet ejection part 41 and the scanner 200 as in the image forming apparatus 500 illustrated in FIG. 1, vibration when a recording sheet P comes in contact with the top face of the in-body sheet ejection part 41 can be prevented from affecting the scanner 200.

Figure 12A:
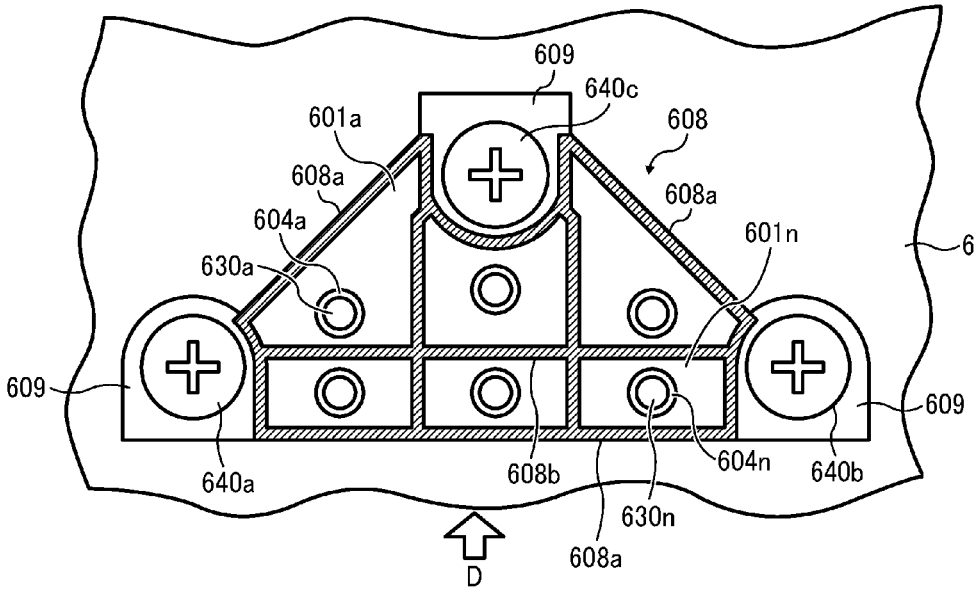
FIGS. 12A and 12B are diagrams illustrating an example of a configuration for fixing one resonance box to an electric box bottom frame with three fastening screws according to an embodiment of the present disclosure, where
Figure 12B:
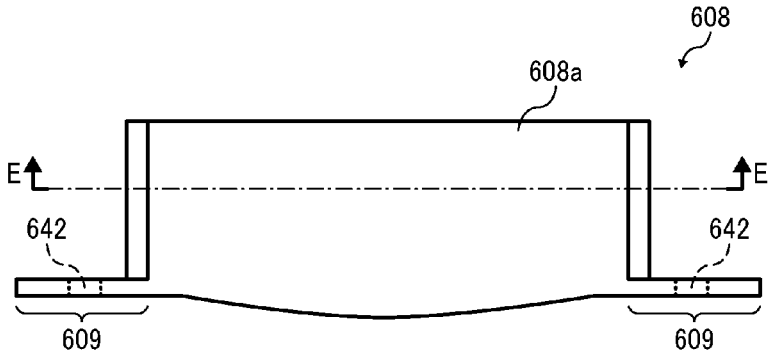

A method of fixing the resonance box 608 to the electric box bottom frame 6 will be described below. FIGS. 12A and 12B are diagrams illustrating a configuration example in which a resonance box 608 is fixed to the electric box bottom frame 6 and a configuration example in which one resonance box 608 is fixed to the electric box bottom frame 6 using three fastening screws 640. FIG. 12A is a cross-sectional view when the resonance box 608 fixed to the electric box bottom frame 6 is viewed from the upside and FIG. 12B is a side view of the resonance box 608 in a state in which the resonance box is not fixed to the electric box bottom frame 6. FIG. 12B is a side view when the resonance box 608 is viewed from the direction of arrow D in FIG. 12A, and the cross-sectional view of the resonance box 608 illustrated in FIG. 12A is a cross-sectional view taken along line E-E in FIG. 12B.

The resonance box 608 forms cavities 601 (601*a* to 601*n*) which are plural resonance spaces corresponding to holes 630 (630*a* to 630*n*) disposed in the electric box bottom frame 6. The holes 630 (630*a* to 630*n*) are disposed inside flange portions 604 (604*a* to 604*n*) on an upper face of the electric box bottom frame 6. The resonance box 608 is fixed by three points of fastening screws 640 (640*a* to 640*c*) such that the bottom face of a screw fastening portion 609 disposed to be connected to the outer circumferential wall 608*a* thereof comes in close contact with the top face of the electric box bottom frame 6. Reference numeral "642" indicated by a dotted line in FIG. 12B denotes a screw hole formed in the resonance box 608 so as to pass the fastening screw 640.

The electric box bottom frame 6 has a structure in which a recessed portion 7 is formed in a simple planar structure, and a portion on the top face of the electric box bottom frame 6 to which the resonance box 608 is fixed has a high-precision plane. By managing the bottom face of the screw fastening portion 609 of the resonance box 608 as a common plane with sufficient precision, the plane coupled to the electric box bottom frame 6 by screw fastening can come in close contact with the high-precision plane which is uniquely determined by the three fastening points. Since the outer circumferential wall 608*a* is arranged to connect the three screw fastening portions 609, the bottom face of the resonance box 608 comes in close contact with the top face of the electric box bottom frame 6 by the fastening force of the fastening screws 640.

At this time, the close contact faces (the bottom faces) of the outer circumferential wall 608*a* and the partition wall 608*b* may be the same plane as the bottom face of the screw fastening portions 609. However, as illustrated in FIG. 12B, the bottom face of the walls may have a shape which slightly projects to the center between the neighboring screw holes 642. In this configuration, the resonance box 608 and the electric box bottom frame 6 can be fixed in a state in which at least one thereof is warped in fastening using the fastening screws 640, thereby improving the close contact property between the bottom face of the resonance box 608 and the electric box bottom frame 6.

Figure 13:
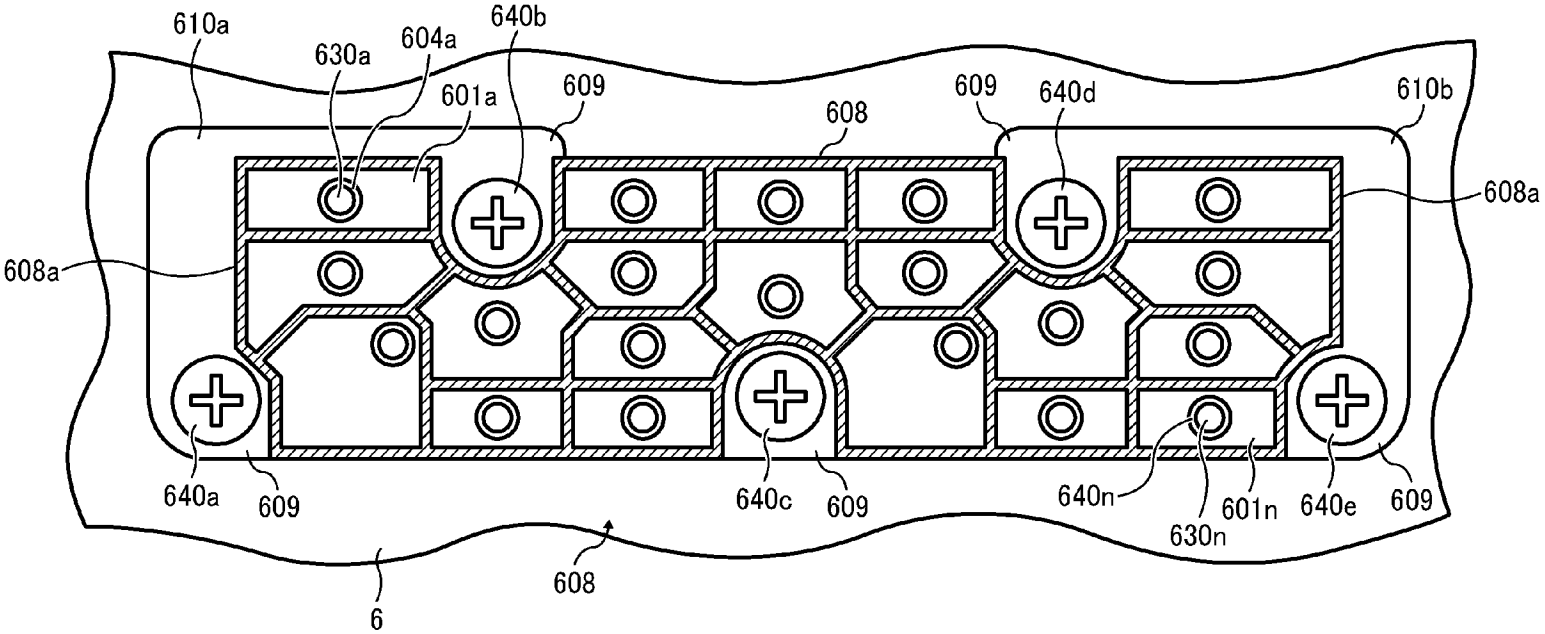
FIG. 13 is a cross-sectional top view illustrating another example of a configuration for fixing a resonance box to an electric box bottom frame according to an embodiment of the present disclosure.

FIG. 13 illustrates another configuration example in which the resonance box 608 is fixed to the electric box bottom frame 6 and is a cross-sectional view when the resonance box 608 fixed to the electric box bottom frame 6 is viewed from the upside. When plural cavities 601 (601*a* to 601*n*) are provided as in the configuration example illustrated in FIG. 13, triangles are constructed to surround the resonance box 608 with plural fastening screws 640 (640*a* to 640*e*). Accordingly, as in the configuration example illustrated in FIGS. 12A and 12B, the configuration in which the resonance box and the electric box bottom frame can come in close contact with each other by the fastening screws 640 at three points can be continuously constructed.

The close contact property of the outermost circumferential portion of the resonance box 608 is improved by forming a large-width close contact face 610 (610*a* and 610*b*) forming the bottom, which is a plane continuous from the bottom face of the screw fastening portion 609, outside the outer circumferential wall 608*a*. Accordingly, even when the number of fastening points of the fastening screws 640 surrounding a cavity 601 is less than three points, it is possible to provide a configuration with an improved close contact property. By using the method of fixing the resonance box 608 to the electric box bottom frame 6, which has been described with reference to FIGS. 12A and 12B and FIG. 13, it is possible to improve the close contact property of the electric box bottom frame 6 and the resonance box 608 with a low-cost and simple configuration and thus to provide a Helmholtz resonator with an excellent sound absorption effect.

[Variation]

Figure 14:
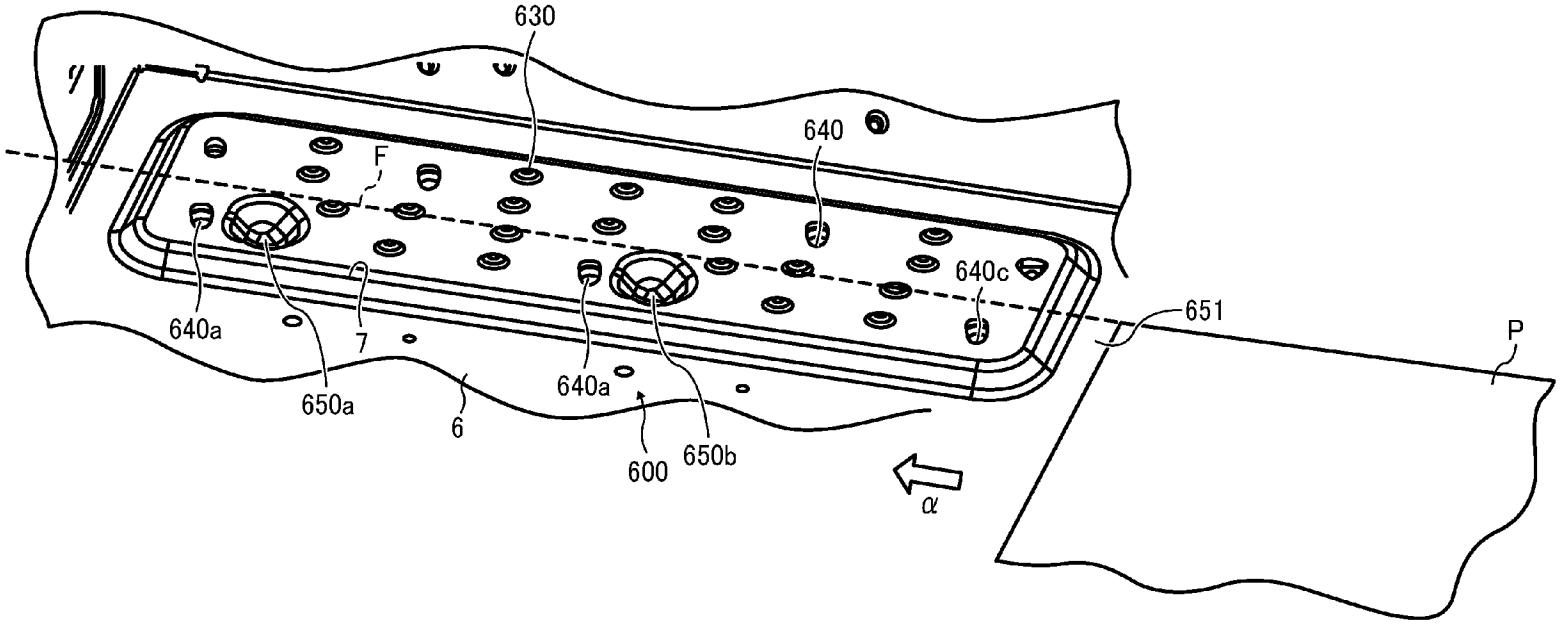
FIG. 14 is a perspective view of a sound absorbing device when an electric unit bottom face of an image forming apparatus according to a variation is viewed from the downside according to an embodiment of the present disclosure.
Figure 15:
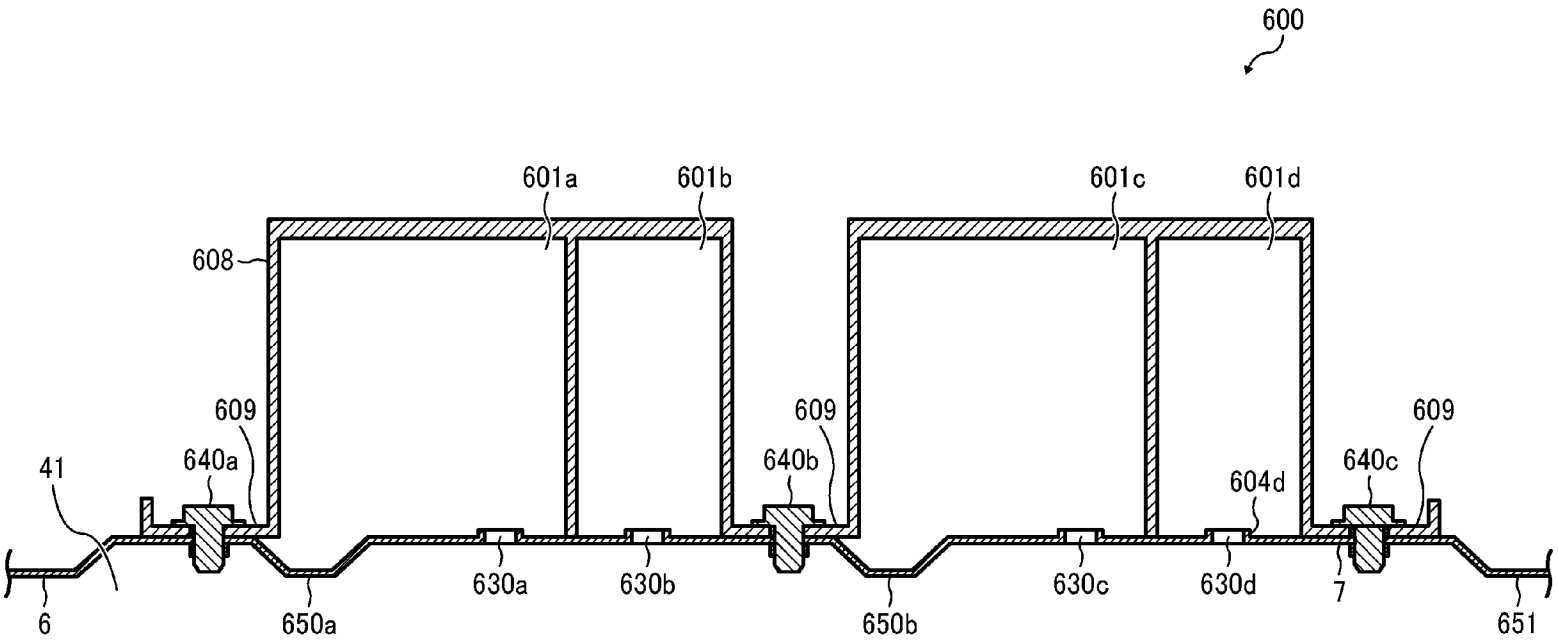
FIG. 15 is a cross-sectional side view of a sound absorbing device according to a variation according to an embodiment of the present disclosure.

A variation of the image forming apparatus 500 including a configuration for preventing a recording sheet P from coming in contact with a protrusion of a fastening screw 640 projecting from the bottom face of the electric box bottom frame 6 will be described below. FIG. 14 is a perspective view of a sound absorbing device 600 when an electric unit bottom face 803 of a image forming apparatus 500 according to the variation is viewed from the downside and FIG. 15 is a cross-sectional side view of the sound absorbing device 600 according to the variation. A lower part (the deep side in the apparatus) of a dotted line F in FIG. 14 is a sheet-passing region below which a recording sheet P ejected from the sheet ejection port 40 passes and an upper part (the near side in the apparatus) of the dotted line F is a non-sheet-passing region below which a recording sheet P ejected from the sheet ejection port 40 does not pass. As illustrated in FIGS. 14 and 15, the image forming apparatus 500 according to the variation has a configuration in which a bottom-face projection 650 is disposed upstream in the sheet ejection direction from the protrusion of the fastening screw 640 in the electric box bottom frame 6.

In order to improve the close contact property between the electric box bottom frame 6 and the resonance box 608, it is effective to fasten planar structures with the fastening screws 640. However, an end of a screw such as a screw tip or a screw head of the fastening screw 640 projects to the in-body sheet ejection part 41 side. In FIGS. 14 and 15 illustrate a state in which the screw tips of the fastening screws 640 project to the in-body sheet ejection part 41 side.

In an electrophotographic system using solid (powder) toner, since a large amount of heat is applied to a sheet at the time of fixing, it is known that a curl due to a difference in an amount of moisture evaporated between a front side and a rear side of the sheet is generated. In the image forming apparatus 500, the ends of the fastening screws 640 project as screw protrusions to the in-body sheet ejection part 41 side on the bottom face of the electric box bottom frame 6. When the screw protrusions face the vicinity of an edge of an ejected sheet P, there is a possibility that the tip of the curled sheet P will come in contact with the screw protrusion to deform the sheet P.

When it is intended to absorb sound leaking from the sheet ejection port 40, it is preferable that the sound absorbing device 600 be disposed above the ejected sheet P and at a position close to a sheet ejection face, but as the sound absorbing device 600 approaches the sheet ejection face, the tip of the curled sheet P is more likely to come in contact with the screw protrusion. By fastening the resonance box 608 to the electric box bottom frame 6 which is a frame above the sheet ejection face with screws, the sound absorbing device 600 can be disposed at a position close to the sheet ejection face with a low-cost configuration. However, when the resonance box 608 is fastened to the electric box bottom frame 6 with the screws, the ends of the fastening screws 640 project as the screw protrusions to the in-body sheet ejection part 41 side.

In the image forming apparatus 500 according to the variation, the portion of the electric box bottom frame 6 to which the resonance box 608 is attached is formed as the recessed portion 7. Regarding the screw protrusion disposed on the uppermost stream in the sheet ejection direction among the plural screw protrusions, since a sheet P can be pushed down with a stepped face 651 which is a relatively-convex face just before the sheet P reaches a position facing the screw protrusion, it is possible to prevent the tip of the sheet P from coming in contact with the screw protrusion. The same structure as the stepped face 651 is also included in the image forming apparatus 500 according to the above-mentioned embodiment.

In the image forming apparatus 500 according to the variation, bottom-face projections 650 (650*a* and 650*b*) are disposed at positions close to the screw projections (the screw tips of the screws "640*a*" and "640*b*") on the upstream side in the sheet ejection direction on the bottom face of the recessed portion 7 which is a rear face of the planar portion of the electric box bottom frame 6 to which the resonance box 608 is fixed. The electric box bottom frame 6 of the image forming apparatus 500 according to the variation is formed of metal and the bottom-face projections 650 (650*a* and 650*b*) are formed by a drawing process using ductility of metal. By providing the bottom-face projections 650, it is possible to prevent a sheet P from coming in contact with the screw protrusion located downstream in the sheet ejection direction like the stepped face 651.

In the image forming apparatus 500 according to the variation, since the screw protrusion may be located above a region through which a sheet P passes in the in-body sheet ejection part 41, the electric box bottom frame 6 is provided with the recessed portion 7 and the bottom-face projections 650. In the variation, by guiding a sheet P using the stepped face 651 disposed upstream in the sheet ejection direction from the recessed portion 7 and the bottom-face projections 650 (650*a* and 650*b*) such that the tip of the sheet P does not come in contact with the screw protrusions, it is possible to prevent the tip of an ejected sheet P from being folded.

As illustrated in FIG. 15, a protrusion-shaped inner space of the bottom-face projection 650 may be used as a part of the cavities 601 (601*a* and 601*c*) of the Helmholtz resonators. Accordingly, since upward extending of the occupied space of the resonance box 608 can be suppressed and the volume of the cavity 601 can be increased, it is possible to implement a configuration on which the sound absorbing device 600 using a space-saving Helmholtz resonator is mounted. In the variation, since the bottom-face projection 650 are incorporated into the electric box bottom frame 6, it is possible to guide a sheet P without increasing the number of components and to implement a configuration having an effective sound absorbing device 600 at a low cost without damaging sheet ejection ability.

The present disclosure is not limited to an image forming apparatus in which the image forming section and the image reader are disposed above and below the in-body sheet ejection part. That is, the present disclosure can be applied to a configuration in which a recording medium is ejected onto the ejected recording medium container disposed in a space formed in the middle in the up-down direction in the apparatus and the ejected recording medium is taken out of an opening formed on a side face of the apparatus body with a hand inserted into the opening.

For example, the present disclosure can be applied to a printer or the like in which the ejected recording medium container is disposed in a space which is formed between the image forming section disposed in an upper part of the apparatus body and a sheet cassette disposed in a lower part of the apparatus body and which is opened to at least one side wall of the apparatus body.

In addition, the present disclosure is not limited to the configuration in which the ejected recording medium container is disposed in a space surrounded with top and bottom wall and opened to a side of the apparatus body, but may have a configuration in which a recording medium is ejected to an ejected recording medium container which is not surrounded with the top wall or the bottom wall. That is, the present disclosure can be applied to a printer or the like in which an ejected recording medium container opened to at least one side wall and not surrounded with the top wall is disposed in an upper part of the apparatus body.

The content of the present disclosure can be applied to a printer, a copier, or the like in which an ejected recording medium container opened to at least one side wall and not surrounded with the bottom wall is disposed in a lower part of the apparatus body. For example, the present disclosure can be applied to a printer or like which includes a top wall surrounds an ejected recording medium container along with an installation face such as a floor or a pedestal on which the apparatus is installed and in which a recording medium is ejected to the ejected recording medium container formed in the lower part of the apparatus body from the ejection port.

The above description provides only examples and the present disclosure exhibits, for example, the following aspects and effects.

(Aspect A) An image forming apparatus, such as the image forming apparatus 500, includes: an image forming section, such as the image forming section 100, to form an image on a recording medium, such as a recording sheet P, and eject the recording medium from an ejection port, such as sheet ejection port 40; a sound absorber, such as the sound absorbing device 600; an ejected recording medium container, such as the in-body sheet ejection part 41, including an opening at at least one side of an apparatus body, such as the apparatus front face, and a space facing the ejection port to contain the recording medium ejected from the ejection port. The sound absorber is disposed on the ejected recording medium container, such as the scanner bottom face 203. According to this configuration, as described in the above-described embodiment, though sound from the ejection port transmits in the ejected recording medium container, the sound absorber disposed on the ejected recording medium container reduces transmission of sound from the ejected recording medium container to a surrounding of the apparatus via the opening. Such a configuration reduces noise due to transmission of sound generated in the apparatus to the outside from the ejection port. Such a configuration also obviates the necessity of a space for the sound absorber around the recording medium conveyance path near the ejection port, thus preventing a size increase of a portion constituting the recording medium conveyance path leading to the ejection port in the apparatus. In this way, in Aspect A, it is possible to prevent sound generated in the apparatus from transmitting to the outside from the ejection port to serve as noise and to prevent an increase in size of the portion constituting the recording medium conveyance path leading to the ejection port in the apparatus.

(Aspect B) In Aspect A, the sound absorber, such as the sound absorbing device 600, may be disposed on a bottom face of a member, such as the scanner 200, located above the ejected recording medium container, such as the in-body sheet ejection part 41. According to this configuration, as described in the above-described embodiment, when recording media, such as recording sheets P, are stacked in the ejected recording medium container, the recording media does not block between the ejection port, such as the sheet ejection port 40, and the sound absorber, thus maintaining the sound absorbing effect.

(Aspect C) In Aspect A or B, the sound absorber, such as the sound absorbing device 600, may be disposed between a predetermined operation position of a user, such as a position on the front face of the apparatus body, and the ejection port, such as the sheet ejection port 40. According to this configuration, as described in the above-mentioned embodiment, the sound absorber is disposed between an operation position at which a user performs an operation, such as the vicinity of the control panel 501, and the ejection port, thus effectively reducing transmission of sound from the ejection port to the operation position of the user. As a result, it is possible to effectively prevent operation sound, which may give discomfort to the user, from transmitting to the user to serve as noise.

(Aspect D) In any one of Aspects A to C, the sound absorber, such as the sound absorbing device 600, may employ a Helmholtz resonator. According to this configuration, as described in the above-mentioned embodiment, by matching the sound absorption frequency of the Helmholtz resonator with the frequency of sound to be absorbed, it is possible to implement the sound absorber that absorbs sound transmitting to the ejected recording medium container, such as the in-body sheet ejection part 41. A configuration using a sound absorbing material such as sponge or glass fiber can be exemplified as the sound absorber other than the configuration using the Helmholtz resonator.

(Aspect E) In Aspect D, a metal frame of the apparatus body, such as the scanner bottom frame 604, may be used as a member constituting a neck, such as the communication portion 603, of the Helmholtz resonator. According to this configuration, as described in the above-mentioned embodiment, by forming holes, such as the holes 630, in the metal frame and attaching a container member, such as the resonance box 608, to form a Helmholtz resonator, it is possible to achieve a decrease in the number of components and space saving.

(Aspect F) In Aspect E, a place in which the Helmholtz resonator is disposed in the metal frame, such as the scanner bottom frame 604, may have a shape with a step difference from a surrounding thereof. According to this configuration, as described in the above-mentioned embodiment, since the strength of the metal frame is enhanced due to the three-dimensional shape and the metal frame is not easily deformed, it is possible to easily secure sealability of the metal frame and the container member such as the resonance box 608.

(Aspect G) In Aspect F, a portion on which the Helmholtz resonator is disposed may be recessed from the surrounding in the ejected recording medium container, such as the in-body sheet ejection part 41. According to this configuration, as described in the above-mentioned embodiment, since sound is easily gathered in an entrance of the neck such as the communication portion 603 of the sound absorber, such as the sound absorbing device 600, sound can easily enter the neck and it is thus possible to achieve improvement in a sound absorption effect.

(Aspect K) In any one of Aspects D to G, a neck, such as the communication portion 603, of the Helmholtz resonator may be made of a burring portion formed by burring on a metal sheet and the burring portion may project to the opposite side of the ejected recording medium container, such as the in-body sheet ejection part 41, to the metal sheet. According to this configuration, as described in the above-mentioned embodiment, since the edge of the metal sheet due to the burring is not conspicuous, it is possible to enhance safety and to cause the burring portion not to hinder a user.

(Aspect I) In any one of Aspects D to H, plural Helmholtz resonators may be provided, and at least one Helmholtz resonator may be different in resonant frequency from the other Helmholtz resonator. According to this configuration, as described in the above-mentioned embodiment, it is possible to form Helmholtz resonators corresponding to different frequencies and thus to achieve improvement in a sound absorption effect.

(Aspect J) In any one of Aspects D to I, the image forming apparatus may include an image reader, such as the scanner 200, serving as a structural component constituting a device above the ejected recording medium container, such as the in-body sheet ejection part 41, and a container member, such as the resonance box 608, to form a resonant space in a frame, such as the scanner bottom frame 604, of the image reader to from the Helmholtz resonator. As described in the above-described embodiment, such a configuration secures available spaces in the frame of the image reader, thus facilitating mounting of additional components. Accordingly, when the container member is disposed inside the frame or mounted on the exterior of the frame, a high degree of freedom is obtained with respect to the fastening positions of the fastener, such as the fastening screw 640 and the arrangement of the Helmholtz resonator.

(Aspect K) In Aspect J, the container member, such as the resonance box 608, is disposed at an opposite side of the ejected recording medium container, such as the in-body sheet ejection part 41, via the frame, such as the scanner bottom frame 604. According to this configuration, as described in the above-mentioned embodiment, holes of the Helmholtz resonator are disposed in the frame, and the container member is disposed at an upper portion of the frame, thus preventing a member constituting the sound absorber, such as the sound absorbing device 600, from projecting into the ejected recording medium container. Such a configuration prevents a newly added sound absorber from disturbing a user.

(Aspect L) An image forming apparatus, such as the image forming apparatus 500, includes: an image forming section, such as the image forming section 100, to form an image on a recording medium, such as a recording sheet P, and eject the recording medium from an ejection port, such as sheet ejection port 40; a sound absorber, such as the sound absorbing device 600; an ejected recording medium container, such as the in-body sheet ejection part 41, that is opened to at least one side of an apparatus body, such as the apparatus front face, and includes a space surrounded with wall faces including a wall face having the ejection port; and an electric board containing box, such as the electric box 1, to contain an electric board, such as the printed circuit board 2, mounting a circuit with an electric component, and the sound absorber and the electric board containing box are disposed on the wall face, such as the top face of the ejected recording medium container, such that at least a part of the sound absorber is included in the electric board containing box. According to this configuration, as described in the above-mentioned embodiment, sound generated in the apparatus and leaking from the ejection port can be prevented from propagating to the outside of the apparatus from the opening of the ejected recording medium container to serve as noise. The reason is as follows. That is, sound leaking from the ejection port propagates the ejected recording medium container. By using a sound absorber which can absorbing the sound propagating from the ejection port to the ejected recording medium container as the sound absorber disposed on the wall face of the ejected recording medium container, it is possible to absorb the sound leaking from the ejection port and thus to prevent the sound from propagating to the outside of the opening of the ejected recording medium container to serve as noise. The electric board containing box occupies a certain space and a gap in which no member is disposed is present therein. By disposing the electric board containing box on the wall face of the ejected recording medium container and locating at least a part of the sound absorber in the gap which is present in the electric board containing box, it is possible to suppress an increase in size of the apparatus due to provision of the sound absorber. In this way, in Aspect A, it is possible to prevent sound generated in the apparatus from propagating to the outside from the ejection port to serve as noise and to suppress an increase in size of the apparatus as a whole.

(Aspect M) In Aspect L, the sound absorber, such as the sound absorbing device 600, and the electric board containing box, such as the electric box 1, may be disposed in a member, such as the electric unit 800, constituting a top face of the ejected recording medium container, such as the in-body sheet ejection part 41. According to this configuration, as described in the above-mentioned embodiment, since the electric board containing box is disposed above the ejected recording medium container, instead of a position contributing to an increase in size in the horizontal direction such as the rear face of the image forming section of the image forming apparatus, it is possible to achieve a decrease in occupied area of the apparatus as a whole.

(Aspect N) In Aspect M, an image reader, such as the scanner 200, may be disposed above the electric board containing box, such as the electric box 1. According to this configuration, as described in the above-mentioned embodiment, it is possible to implement an image forming apparatus having a function of a copier that reads an original image and forms the original image on a recording medium such as a recording sheet P.

(Aspect O) In Aspect N, a first housing, such as the electric unit 800, to house the electric board containing box, such as the electric box 1, and a second housing to house the image reader, such as the scanner 200, may be separately provided from each other. According to this configuration, as described in the above-mentioned embodiment, it is possible to commonize the image forming section 100 as the image forming section to the copier and the printer.

(Aspect P) In any one of Aspects M to O, the sound absorber, such as the sound absorbing device 600, may be disposed on a bottom face of the electric board containing box, such as the electric box. According to this configuration, as described in the above-mentioned embodiment, it is possible to efficiently absorb sound propagating to the ejected recording medium container such as the in-body sheet ejection part 41 located below.

(Aspect Q) In any one of Aspects L to P, the sound absorber such as the sound absorbing device 600 may be disposed between a predetermined operation position of a user, such as a position on the front face of the apparatus body, and the ejection port, such as the sheet ejection port 40. According to this configuration, as described in the above-mentioned embodiment, the sound absorber is disposed between a position at which a user perform an operation such as the vicinity of the control panel 501 and the ejection port. Accordingly, it is possible to effectively prevent sound leaking from the ejection port from propagating to the position of the user. As a result, it is possible to effectively prevent operation sound, which may give discomfort to the user, from propagating to the user to serve as noise.

(Aspect R) In any one of Aspects L to Q, the sound absorber such as the sound absorbing device 600 may employ a Helmholtz resonator. According to this configuration, as described in the above-mentioned embodiment, by matching the sound absorption frequency of the Helmholtz resonator with the frequency of sound to be absorbed, it is possible to implement the sound absorber that absorbs sound propagating to the ejected recording medium container, such as the in-body sheet ejection part 41. A configuration using a sound absorbing material such as sponge or glass fiber can be exemplified as the sound absorber other than the configuration using the Helmholtz resonator.

(Aspect S) In Aspect R, a metal frame of the apparatus body, such as the electric box bottom frame 6, may be used as a member constituting a neck, such as the communication portion 603, of the Helmholtz resonator. According to this configuration, as described in the above-mentioned embodiment, by forming holes, such as the holes 630, in the metal frame and attaching a container member, such as the resonance box 608, to form a Helmholtz resonator, it is possible to achieve a decrease in the number of components and space saving.

(Aspect T) In Aspect S, a place in which the Helmholtz resonator is disposed in the metal frame, such as the electric box bottom frame 6, may have a shape with a step difference from a surrounding thereof. According to this configuration, as described in the above-mentioned embodiment, since the strength of the metal frame is enhanced due to the three-dimensional shape and the metal frame is not easily deformed, it is possible to easily secure sealability of the metal frame and the container member such as the resonance box 608.

(Aspect U) In Aspect T, a portion on which the Helmholtz resonator is disposed may be recessed from the surrounding in the ejected recording medium container, such as the in-body sheet ejection part 41. According to this configuration, as described in the above-mentioned embodiment, since sound is easily gathered in an entrance of the neck such as the communication portion 603 of the sound absorber, such as the sound absorbing device 600, sound can easily enter the neck and it is thus possible to achieve improvement in a sound absorption effect.

(Aspect V) In any one of Aspects R to U, a neck, such as the communication portion 603, of the Helmholtz resonator may be made of a burring portion formed by burring on a metal sheet and the burring portion may project to the opposite side of the ejected recording medium container, such as the in-body sheet ejection part 41, to the metal sheet. According to this configuration, as described in the above-mentioned embodiment, since the edge of the metal sheet due to the burring is not conspicuous, it is possible to enhance safety and to cause the burring portion not to hinder a user.

(Aspect W) In any one of Aspects R to V, plural Helmholtz resonators may be provided, and at least one Helmholtz resonator may be different in resonant frequency from the other Helmholtz resonator. According to this configuration, as described in the above-mentioned embodiment, it is possible to form Helmholtz resonators corresponding to different frequencies and thus to achieve improvement in a sound absorption effect.

(Aspect X) In any one of Aspects R to W, at least a part (the resonance box 608) of the member constituting a cavity, such as the cavity 601, of the Helmholtz resonator may be an insulator. According to this configuration, as described in the above-mentioned embodiment, at least a part of the member forming the cavity can be disposed up to a position close to the electric board such as the printed circuit board 2 in the gap in the electric board containing box such as the electric box 1. Accordingly, it is possible to effectively utilize the gap in the electric board containing box.

(Aspect Y) In any one of Aspects R to X, a member, such as the resonance box 608, constituting a cavity of the Helmholtz resonator may have a shape to regulate a channel of a harness member electrically connecting the electric board, such as the printed circuit board 2, to another member. According to this configuration, as described in the above-mentioned embodiment, it is possible to achieve improvement in operability capable of facilitating access to the electric board at the time of assembly or maintenance or replacement.

(Aspect Z) In any one of Aspects R to Y, two members, such as the electric box bottom frame 6 and the resonance box 608, may be fixed to form a cavity, such as the cavity 601, of the Helmholtz resonator surrounded with the two members and the two members may be fixed by fastening the two members at three or more fastening points, such as the screw holes 642, using a fastener, such as the fastening screw 640. According to this configuration, as described in the above-mentioned embodiment, since the two members can be brought into close contact with each other in a high-precision plane which is uniquely determined by the three fastening points, it is possible to improve close contact precision and thus to improve sealability of the cavity. Accordingly, it is possible to achieve improvement in a sound absorption effect of the sound absorber using a low-cost fixing method such as fastening using the fasteners.

(Aspect AA) In Aspect Z, a wall portion, such as the outer circumferential wall 608*a* which is a part of one member (such as the resonance box 608) of the two members, such as the electric box bottom frame 6 and the resonance box 608, and which stands upright in a direction perpendicular to a contact face (such as the bottom face of the screw fastening portion 609) with the other member (such as the electric box bottom frame 6) to form a wall face of the cavity such as the cavity 601 may form a triangle connecting the three or more fastening points, such as the holes 642. According to this configuration, as described in the above-mentioned embodiment, since the two members can be brought into close contact with each other in a high-precision plane which is uniquely determined by the three fastening points, it is possible to improve close contact precision and thus to improve sealability of the cavity. Accordingly, it is possible to achieve improvement in a sound absorption effect of the sound absorber using a low-cost fixing method such as fastening using the fasteners.

(Aspect AB) In Aspect Z or AA, a contact face (such as the bottom faces of the outer circumferential wall 608*a* and the partition wall 608*b*) of one member (such as the resonance box 608) with the other member (such as the electric box bottom frame 6) out of the electric box bottom frame 6 and the resonance box 608 may have a shape in which an intermediate point of the neighboring fastening points such as the screw holes 642 projects from the fastening points. According to this configuration, as described in the above-mentioned embodiment, by fixing at least one of the two members in a state in which at least one thereof is curved, it is possible to improve a close contact property between the contact faces of the two members. Accordingly, it is possible to improve sealability of the cavity and thus to achieve improvement in a sound absorption effect of the sound absorber using a low-cost fixing method such as fastening using the fasteners.

(Aspect AC) In any one of Aspects L to AB, a part such as the screw tip of a fixing member such as the fastening screw 640 fixing the sound absorber such as the sound absorbing device 600 to the apparatus body such as the image forming apparatus 500 may project from the wall face such as the bottom face of the electric box bottom frame 6 to the ejected recording medium container such as the in-body sheet ejection part 41 to form a fixing member protrusion such as the screw protrusion, and a protrusion-shaped portion such as the bottom-face projection 650 guiding a recording medium such that the recording medium such as a sheet P ejected to the ejected recording medium container does not contact with the fixing member protrusion may be disposed in the vicinity of the fixing member protrusion of the wall face. According to this configuration, as described in the above-mentioned embodiment, it is possible to prevent the recording medium ejected to the ejected recording medium container from coming in contact with the fixing member protrusion and thus to implement a configuration including an effective sound absorber at a low cost without damaging sheet ejection ability.

(Aspect AD) In Aspect AC, the sound absorber such as the sound absorbing device 600 may be arranged to absorb sound using the cavity such as the cavity 601, the protrusion-shaped portion such as the bottom-face projection 650 may have a protrusion-shaped inner cavity such as a protrusion-shaped inner space therein, and the protrusion-shaped inner cavity may constitute at least a part of the cavity of the sound absorber. According to this configuration, as described in the above-mentioned embodiment, it is possible to implement a configuration including an effective sound absorber with a saved space without damaging sheet ejection ability.

(Aspect AE) In Aspect AC or AD, the protrusion-shaped portion such as the bottom-face projection 650 may be disposed separately from a member such as the electric box bottom frame 6 forming the wall face. According to this configuration, as described in the above-mentioned embodiment, since a recording medium such as a sheet P can be guided without increasing the number of components, it is possible to implement a configuration including an effective sound absorber such as the sound absorbing device 600 at a low cost without damaging sheet ejection ability.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image forming section configured to form an image on a recording medium;

a scanner including:

an exposure glass on which an original document having a reading target image on a document surface may be placed; and a light source configured to emit light to the exposure glass;

an ejection port disposed between the scanner and the image forming section and configured to eject the recording medium;

an ejected recording medium container configured to contain the recording medium ejected from the ejection port; and a sound absorber having an opening and a cavity corresponding to the opening, the sound absorber including a plurality of sound absorbers disposed between the exposure glass of the scanner and the ejected recording medium container and inside a lower frame of the scanner, the opening of the sound absorber being provided in a bottom face of a body which forms a lower face of the scanner and which is disposed above the ejected recording medium container, the opening of the sound absorber opening oriented toward the ejected recording medium container.

2. The image forming apparatus according to claim 1, wherein the sound absorber includes a Helmholtz resonator.

3. The image forming apparatus according to claim 2, wherein the plurality of sound absorbers includes at least one sound absorber having a sound absorbing frequency different from respective sound absorbing frequencies of the other sound absorbers.

4. The image forming apparatus according to claim 1, wherein the plurality of sound absorbers include a plurality of Helmholtz resonators, wherein a hole of at least one of the plurality of Helmholtz resonators opens toward the ejected recording medium container, and wherein a hole of at least a different one of the plurality of Helmholtz resonators opens toward the inside of the image forming apparatus.

5. The image forming apparatus according to claim 1, wherein the sound absorber has a surface forming the opening, and wherein the surface forming the opening of the sound absorber has a concave recessed portion toward the scanner, from the bottom face of the body which forms a lower face of the scanner and which is disposed above the ejected recording medium container.

6. The image forming apparatus according to claim 5, further comprising a fastener by which a body forming the cavity of the sound absorber is fixed to the surface forming the opening of the sound absorber, wherein a container side end of the fastener is disposed closer to the scanner than the bottom face of the body which forms a lower face of the scanner and which is disposed above the ejected recording medium container.

7. The image forming apparatus according to claim 6, further comprising a projection formed in the surface forming the opening of the sound absorber, wherein a tip of the projection is disposed at a position closer to the ejected recording medium container than the container side end of the fastener.

8. The image forming apparatus according to claim 6, wherein the sound absorber includes a flange configured to form the opening, and wherein the flange projects oriented toward the cavity.

* * * * *